US006663233B2

(12) United States Patent
Otsuka et al.

(10) Patent No.: US 6,663,233 B2
(45) Date of Patent: Dec. 16, 2003

(54) INKJET PRINTING APPARATUS AND INK SUPPLYING METHOD

(75) Inventors: Naoji Otsuka, Kanagawa (JP); Hiroyuki Inoue, Kanagawa (JP); Masahito Yoshida, Saitama (JP); Takashi Nojima, Tokyo (JP); Hitoshi Sugimoto, Kanagawa (JP); Shusuke Inamura, Tokyo (JP); Yasufumi Tanaami, Tokyo (JP); Takeshi Iwasaki, Kanagawa (JP); Noriko Sato, Kanagawa (JP); Yasuyuki Hirai, Kanagawa (JP); Takeshi Yazawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/171,652

(22) Filed: Jun. 17, 2002

(65) Prior Publication Data

US 2003/0007048 A1 Jan. 9, 2003

(30) Foreign Application Priority Data

Jun. 18, 2001 (JP) ..... 2001-183741

(51) Int. Cl.[7] ..... B41J 2/175

(52) U.S. Cl. ..... 347/85; 347/87; 141/114; 141/351

(58) Field of Search ..... 347/84, 85, 86, 347/87; 141/114, 351, 25; 222/92, 149, 527, 633

(56) References Cited

U.S. PATENT DOCUMENTS

| | | | | | |
|---|---|---|---|---|---|
| 4,422,084 | A | * | 12/1983 | Saito | 347/7 |
| 5,751,319 | A | * | 5/1998 | Robertson et al. | 347/85 |
| 5,880,748 | A | * | 3/1999 | Childers et al. | 347/6 |
| 5,886,718 | A | * | 3/1999 | Johnson et al. | 347/85 |
| 5,936,650 | A | | 8/1999 | Ouchida et al. | 347/89 |
| 6,007,192 | A | * | 12/1999 | Ahn | 347/87 |
| 6,199,975 | B1 | * | 3/2001 | Baitz et al. | 347/85 |

FOREIGN PATENT DOCUMENTS

| | | |
|---|---|---|
| EP | 927638 | 7/1999 |
| JP | 10-128999 | 5/1998 |

* cited by examiner

*Primary Examiner*—Anh T.N. Vo
(74) *Attorney, Agent, or Firm*—Fitzpatrick, Cella, Harper & Scinto

(57) ABSTRACT

In a structure which includes a second tank for reserving a predetermined amount of ink to be supplied to a printing head and in which a supply system is configured such that ink is intermittently supplied to the second tank from a first tank, a high charging efficiency to and shortened processing time for charging the second tank, and high overall usability of ink are achieved. In an orientation upon using the printing apparatus, a port of a channel located at the second tank side for supplying ink from the first tank to the second tank is arranged relatively high position and an outlet port for supplying ink from the second tank to the head is arranged relatively low position in relation to the direction of gravity, and a port of the channel located at the first tank side is arranged at the bottom of the first tank.

18 Claims, 16 Drawing Sheets

INKJET PRINTING APPARATUS AND INK SUPPLYING METHOD

This application is based on Japanese Patent Application No. 2001-183741 filed Jun. 18, 2001 in Japan, the content of which is incorporated hereinto by reference.

BACKGROUND OF THE INVENTION

1. Field of the Invention

The present invention relates to an inkjet printing apparatus, a printing head, and an ink supplying method and, more particularly, the invention is preferably applied to an inkjet printing apparatus in which ink is intermittently supplied to a printing head for ejecting ink.

2. Descritpion of the Related Art

Inkjet printing apparatuses which form an image on a printing medium by depositing ink to the printing medium using an inkjet printing head include that which forms an image by ejecting ink while moving a printing head relative to a printing medium and that which form an image by ejecting ink while moving a printing medium relative to a fixed printing head conversely.

There are two general types of methods of supplying ink to a printing head in such an inkjet printing apparatus. One is a type in which a supply system is configured such that an amount of ink is always or continuously supplied to a printing head according to the amount of ink ejected (hereinafter referred to as a continuous supply type), and the other is a type in which a printing head is provided with a reservoir (sub-tank or second ink tank) for reserving a predetermined amount of ink and in which a supply system is configured such that ink is supplied to the reservoir from an ink supply source (main tank or first ink tank) at appropriate timing or intermittently (hereinafter referred to as an intermittent supply type).

The continuous supply type is further categorized into two types, for example, when it is used in an inkjet printing apparatus of a type referred to as a serial type in which a printing head is scanned back and forth in predetermined directions relative to a printing medium and in which the printing medium is transported in a direction substantially orthogonal thereto to form an image. One is a type referred to as an on-carriage type in which ink is supplied by integrally or detachably attaching an ink tank to a printing head that is carried and moved back and forth (main scanning) by a carriage. The other is a tube supply type in which an ink tank that is separate from a printing head carried on a carriage is fixedly installed in a part of a printing apparatus other than the printing head and in which the ink tank is connected to the printing head through a flexible tube to supply ink. In some of the latter type, a second ink tank that serves as an intermediate tank between an ink tank and a printing head is mounted on the printing head or the carriage.

When an on-carriage type structure is adopted, there are limits on the project area in a direction perpendicular to the main scanning direction and volume of members that move with a carriage (a printing head and an ink tank undetachably or detachably integrated with the same). Therefore, only an ink tank having a very limited capacity can be used when a small-sized printing apparatus, especially, a portable printing apparatus is to be formed. This results in very frequent replacement of the printing head integral with the ink tank or the ink tank alone, which has been problematic from the viewpoint of operability and running cost. Further, the recent spread of so-called mobile apparatus is remarkable and, for example, ultra-compact inkjet printers have been proposed which can be integrated with notebook type personal computers and digital cameras. It is considered impractical to design such printers in adaptation to the on-carriage method.

When a tube supply type structure is adopted, although members that move with a carriage during main scanning can be made compact to some degree, it is difficult to make the apparatus as a whole compact because a space is required for a tube member to move to follow up the carriage, the tube member coupling a printing head on the carriage and an ink tank located outside the carriage to supply ink. Further, the recent trend is that a carriage is scanned at a high speed to accommodate increases in the speed of printing operations, and resultant severe rocking of a tube that follows the carriage results in changes in the pressure of ink in an ink supply system for the printing head. It is therefore required to provide various complicated pressure buffering mechanisms in order to suppress pressure changes, it has been difficult to achieve a size reduction in this respect too.

On the contrary, in the case of the intermittent supply method that is used for serial type inkjet printing apparatus for example, a relatively small second ink tank and printing head are provided on a carriage; a relatively large first ink tank is provided in a part other than the carriage of the printing apparatus; and a supply system is configured such that ink is supplied from the first ink tank to the second ink tank at appropriate timing. A structure is also employed in which the ink supply system between the first and second ink tanks is spatially separated or the ink channel is blocked with a valve during main scanning to achieve fluid isolation between the first and second ink tanks. Basically, this makes it possible to solve various problems attributable to the size of moving members as described above such as an ink tank and the rocking of a tube that have limited efforts to achieve a small size in the case of the continuous supply type.

When an intermittent supply type structure is adopted, however, it is important to discharge a gas such as air that enters or has entered an ink supply system and to control the pressure inside the same properly.

There are four general causes for the entrance of a gas into a supply system.

1) A gas can enter through ink ejection openings of a printing head or can generate as a result of an ejecting operation.
2) A gas that has been dissolved in ink can be separated from the same.
3) A gas can enter a supply system from the outside through the material from which the supply system is formed as a result of permeation.
4) A gas can enter when a joint is coupled to couple a first ink tank and a second ink tank.

The entrance of a gas is a problem that inevitably occurs, although the amount of the gas varies depending on the structure of the supply system. When a gas is accumulated in a second ink tank on a carriage for example, a problem arises in that the efficiency of charging the second ink tank with ink is reduced accordingly. Further, unexpected pressure changes are caused by expansion and contraction of air in response to temperature changes. This can result in leakage of ink from ejection openings attributable to an action of a resultant excessively large positive pressure or can conversely result in a failure of ink ejection attributable to an action of an excessively large negative pressure. Furthermore, the gas accumulated in the second ink tank can be included in ink that is guided to the ejection openings to cause problems such as disablement of ink ejection.

Such problems can be similarly caused when a continuous supply system of the tube supply type is configured. In a tube supply type continuous supply system in the related art, measures have been taken against such entrance of a gas, including a recovery operation for discharging ink and the gas from the printing head by simultaneously sucking them through the ejection openings thereof periodically or forcibly and a recovery operation performed in case that a second ink tank is carried by the carriage in which the gas is forcibly discharged from the second ink tank along with ink concurrently with an operation of sucking them through the ejection openings.

Since a great amount of waste ink is generated as a result of the adoption of such measures, serious limits are put on designing when a compact and portable printing apparatus is to be provided using the intermittent supply method. Further, a long time must be included in a control sequence of the printing apparatus to accommodate at least a recovery operation for sucking ink from the ejection openings of the printing head in addition to an operation of filling the second ink tank with ink at appropriate timing. In addition, since it is also required to perform a wiping operation for removing ink deposited on the surface of the printing head having the ejection openings formed thereon as a post-process for the recovery operation and a preliminary ejecting operation, a problem arises in that a further time is spent accordingly.

Referring to the continuous supply system of the tube supply type, in the case of an inkjet printing apparatus in which a pressure that is negative relative to the atmosphere must be generated to hold ink meniscuses formed at the ejection openings, there are limits including a need for providing the first ink tank in a position lower than the position of the ejection openings of the printing head in order to generate a negative pressure in the first ink tank naturally. This puts a limit on even the position and attitude or orientation of the ink tank and has resulted in problems including leakage of ink from the ejection openings especially in case that a portable printing apparatus is to be provided which is unstable in attitude during transportation.

On the contrary, proposals have been made for the adoption of the intermittent supply system, including a proposal in which a film having a function of allowing a gas to pass while disallowing a liquid to pass (hereinafter simply referred to as a functional film) is disposed to separately discharge only a gas from the second ink tank by force through the functional film and in which a porous member such as a sponge for holding ink is contained in the second ink tank to generate an adequate negative pressure therein. Such a structure is advantageous for even a portable printing apparatus whose attitude is unstable during transportation because it effectively suppresses an increase in the amount of waste ink generated during when ink is charged.

However, in order to use the functional film with stability, it is required that the film stays in a chemically inert state for a long time, which has resulted in a problem in that freedom in selecting ink is reduced, ink having a composition that does not affect the functional film must be selected.

When the functional film is provided on the second ink tank, a gas can conversely flow in the direction of entering the second ink tank. When a negative pressure generating mechanism such as a porous member for keeping ink under a negative pressure relative to a nozzle of the printing head is provided in the second ink tank for this reason, the efficiency of containing ink in the second ink tank is limited. Designing may be limited with respect to deposition of dyes and pigments in ink and endurance of the porous member against deterioration, which also reduces alternatives in selecting ink.

Further, in such a structure, since the porous member is always over-charged with ink when ink charging is completed, the over-charged ink in the porous member must be discharged as waste ink without fail by performing an operation of sucking the printing head through the ejection openings after the charging is completed in order to apply a required negative pressure to the printing head. That is, a problem arises in that a charging operation is accompanied by the generation of waste ink.

SUMMARY OF THE INVENTION

The invention was made taking the above problems into consideration, and it provides a structure in which an intermittent supply system is adopted as an ink supply system; high charging efficiency and a short charging time is achieved; and high overall usability of ink is achieved.

The invention thus contributes to the structure of a compact and portable inkjet printing apparatus.

In an aspect of the present invention, there is provided an inkjet printing apparatus for performing printing on a printing medium by using a printing head for ejecting ink, comprising:

a first ink tank serving as a source of the ink;

a second ink tank which can be charged with ink from the first ink tank and which supplies the ink to the printing head during printing; and ink transport means for charging the second ink tank with the ink from the first ink tank, wherein in relation to the direction of gravity in an orientation upon using the printing apparatus, a port of a channel located at a side of the second ink tank for supplying ink from the first ink tank to the second ink tank is arranged relatively high position and an ink outlet port for supplying ink from the second ink tank to the printing head is arranged relatively low position respectively, and a port of the channel located at a side of the first ink tank is arranged to position at the bottom of the first ink tank.

In another aspect of the present invention, there is provided an ink supplying method used for an inkjet printing apparatus for performing printing on a printing medium by using a printing head for ejecting ink, the method comprising the steps of;

providing an inkjet printing apparatus having:

a first ink tank serving as a source of the ink;

a second ink tank which can be charged with ink from the first ink tank and which supplies the ink to the printing head during printing; and ink transport means for charging the second ink tank with the ink from the first ink tank, wherein in relation to the direction of gravity in an orientation upon using the printing apparatus, a port of a channel located at a side of the second ink tank for supplying ink from the first ink tank to the second ink tank is arranged relatively high position and an ink outlet port for supplying ink from the second ink tank to the printing head is arranged relatively low position respectively, and a port of the channel located at a side of the first ink tank is arranged to position at the bottom of the first ink tank; and wherein the ink transport means can return the contents of the second ink tank to the first ink tank, and in relation to the direction of gravity in an orientation upon using the printing apparatus, a starting point of a channel for the returning is in a relatively high position on the second ink tank in relation to the direction of gravity and a starting point of the channel for supplying ink to the printing head is in a relatively low position on the second ink tank in relation to the direction of gravity;

charging the second ink tank with the ink from the first ink tank by increasing the internal volume of the second ink tank; and returning the contents of the second ink tank to the first ink tank by reducing the internal volume of the second ink tank.

According to the structure as set forth above, such an inkjet printing apparatus can be realized that the one comprises a first ink tank for supplying an ink and a second ink tank capable of charging ink at appropriate time from the first ink tank by an ink transfer means and for supplying the ink with the printing head upon the printing, wherein in an attitude or orientation upon using the printing apparatus a port of a channel located at a side of the second ink tank for supplying ink from the first ink tank to the second ink tank is arranged relatively high position and an ink outlet port for supplying ink from the second ink tank to the printing head is arranged relatively low position respectively in relation to the direction of gravity, and a port of the channel located at a side of the first ink tank is designed to position at the bottom of the first ink tank, thereby achieving a high charging efficiency to and shortened processing time for charging the second ink tank, and high overall usability of ink as well.

Moreover, due to the ink transfer means, the content of the second ink tank can be returned to the first ink tank appropriately prior to a charging operation. Also, because a point of the channel for starting the return is arranged at relatively high position on the second ink tank in an attitude or an orientation upon using the printing apparatus in relation to the direction of gravity, a gas residing within the second ink tank is transferred to the first ink tank securely and smoothly to achieve a smooth gas-liquid separation within the first ink tank. Such structure further enables avoiding gas thus returned to the first ink tank flowing into the second ink tank again.

Incidentally, in the present specification, the wording "printing" means not only a condition of forming significant information such as characters and drawings, but also a condition of forming images, designs, patterns and the like on printing medium widely or a condition of processing the printing media, regardless of significance or unmeaning or of being actualized in such manner that a man can be perceptive through visual perception.

Further, the wording "printing medium" means not only a paper used in a conventional printing apparatus but also everything capable of accepting inks, such as fabrics, plastic films, metal plates, glasses, ceramics, wood and leathers, and in the following, will be also represented by a "sheet" or simply by "paper".

Still further, the wording "ink" (also referred to as "liquid" in some occasions) should be interpreted in a broad sense as well as a definition of the above "printing" and thus the ink, by being applied on the printing media, shall mean a liquid to be used for forming images, designs, patterns and the like, processing the printing medium or processing inks (for example, coagulation or encapsulation of coloring materials in the inks to be applied to the printing media).

Meantime, the present invention may be applied to a printing head in which a thermal energy generated by an electrothermal transducer is utilized to cause a film boiling to liquid in order to form bubbles, a printing head in which an electromechanical transducer is employed to eject liquid, a printing head in which a static electricity or air current is utilized to form and eject a liquid droplet and the others which are proposed in the art of an inkjet printing technology. Specifically, the printing head in which the electrothermal transducer is utilized is advantageously employed to achieve a compact structure.

Still further, the wording "nozzle", as far as not mentioned specifically, represents to an ejection opening, a liquid passage communicated with the opening and an element for generating an energy used for ink, in summary.

The above and other objects, effects, features and advantages of the present invention will become more apparent from the following description of embodiments thereof taken in conjunction with the accompanying drawings.

DETAILED DESCRIPTION OF PREFERRED EMBODIMENTS

The invention will now be described in detail with reference to the drawings.

(Example of Structure of Inkjet Printing Apparatus)

Figure 1:
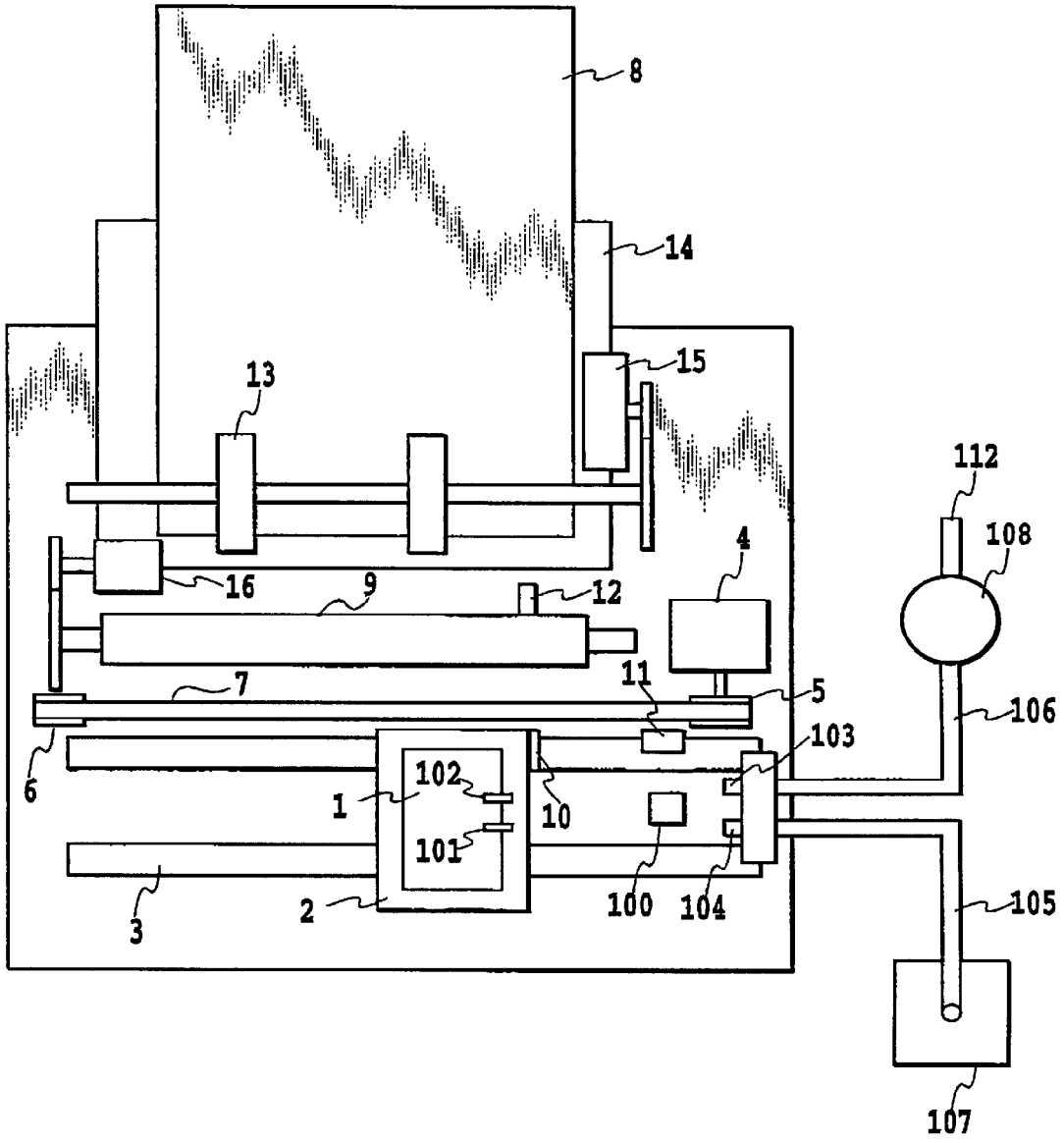
FIG. 1 is a schematic plan view showing a general structure of an inkjet printing apparatus utilizing an intermittent supply system according to an embodiment of the invention.

FIG. 1 is a schematic plan view showing a general structure of an inkjet printing apparatus utilizing an intermittent supply system according to an embodiment of the invention.

In the structure in FIG. 1, a printing head unit 1 is replaceably mounted on a carriage 1. The printing head unit 1 has a printing head section and a second ink tank section, and there is provided a connector (not shown) for transmitting signals such as a drive signal for driving the head section to cause an ink ejecting operation of a nozzle. The carriage 2 on which the printing head unit 1 is positioned and replaceably mounted is provided with a connector holder (electrical connecting section) for transmitting signals such as the drive signal to the printing head unit 1 through the connector.

The carriage 2 is guided and supported by a guide shaft 3 provided on a main body of the apparatus and extending in a main scanning direction such that it can be moved back and forth along the guide shaft. The carriage 2 is driven and controlled with respect to its position and movement by a main scanning motor 4 through transmission mechanisms such as a motor pulley 5, a driven pulley 6, and a timing belt 7. For example, a home position sensor 10 in the form of a transmission type photo-interrupter is provided, and a blocking plate 11 is disposed in a fixed part of the apparatus associated with a home position of the carriage such that it can block an optical axis of the transmission type photo-interrupter. Thus, when the home position sensor 10 passes through the blocking plate 11 as a result of the movement of the carriage 2, the home position is detected, and the position and movement of the carriage can be controlled using the detected position as a reference.

Printing media 8 that are printing paper or plastic sheets are separately fed one by one from an automatic sheet feeder (hereinafter referred to as an ASF) by rotating a pick-up roller 13 with an ASF motor 15 through a gear. Further, the medium is transported through a position (printing section) in a face-to-face relationship with a surface of the printing head unit 1 where ejection openings are formed as a result of the rotation of a transport roller 9 (sub scanning). The transport roller 9 is driven by transmitting the rotation of a line feed (LF) motor 16 through a gear.

At this time, judgment on whether the paper has been fed and decision of a print starting position on the printing medium in a sub scanning direction is performed based on output of a paper end sensor 12 for detecting the presence of a printing medium disposed upstream of a printing position on a printing medium transport path. The paper end sensor 12 is used to detect a rear end of a printing medium 8 and to decide a final printing position on the printing medium in the sub scanning direction based on the detection output.

The printing medium 8 is supported by a platen (not shown) at a bottom surface thereof such that a flat surface is formed in a portion thereof to be printed. In doing so, the printing head unit 1 carried by the carriage 2 is held such that the surface thereof where the ejection openings are formed protrudes downward from the carriage in parallel with the printing medium 8. For example, the printing head unit 1 is an inkjet printing head unit having a structure for ejecting ink utilizing thermal energy and having an electrothermal transducer for generating thermal energy that causes film boiling of ink. That is, the printing head of the printing head unit 1 performs printing by utilizing the pressure of bubbles generated as a result of film boiling of ink caused by the thermal energy applied by the electrothermal transducer to eject ink. Obviously, a different type of unit such as a unit that ejects ink utilizing a piezoelectric device may be used.

Reference numeral 100 represents a recovery system mechanism that has a cap member used for an operation of recovering suction of ink from the printing head unit 1 and for protecting the surface of the printing head where the ejection openings are formed. The cap member can be set in positions where it is joined to and detached from the surface where the ejection openings are formed by a motor that is not shown. Operations such as the suction recovery operation of the printing head are performed by generating a negative pressure in the cap member by a suction pump which is not shown in the joined state. The surface of the printing head where the ejection openings are formed can be protected by keeping the cap member in the joined state when the printing apparatus is not used.

Reference numeral 101 represents a valve unit provided on the printing head unit side for coupling the printing head unit 1 to an ink supply source. Reference numeral 104 represents a valve unit provided at the ink supply source side to be paired with the valve unit 101. Reference numeral 102 represents a valve unit provided on the printing head unit side for coupling the printing head unit 1 to an air pump unit. Reference numeral 103 represents a valve unit provided on an air pump unit side to be paired with the valve unit 102.

The valve units 101 through 104 are in contact and coupled with the respective valve units to allow ink and air to flow between the valve units when the carriage 2 is located at the home position outside a printing area in the main scanning direction or at a position in the vicinity of the same. The valve units are decoupled from each other when the carriage 2 moves away the position toward the printing area, and the valve units 101 and 104 automatically enter a closed state as a result of the decoupling. On the contrary, the valve unit 102 is always in an open state.

Reference numeral 105 represents a tube member that is coupled with a first ink tank 107 to supply ink to the valve unit 104. Reference numeral 106 represents a tube member for an air pressure or pneumatic circuit, the tube member being coupled with a pump unit 108 for pressurization and depressurization. Reference numeral 112 represents a suction and exhaust port of the pump unit 108. It is not essential to configure each of the tube members as an integral unit, and it may be configured by combining a plurality of tube elements.

(Another Example of Structure of Inkjet Printing Apparatus)

The intermittent supply system in FIG. 1 has a structure in which the valve units are coupled only when the second ink tank is charged with ink and in which the ink supply system between the first and second ink tanks is spatially disconnected during a printing operation. An intermittent supply system may be employed in which the ink channel or a fluid path is blocked with a valve instead of such disconnection to achieve fluid isolation between the first and second ink tanks.

Figure 2:
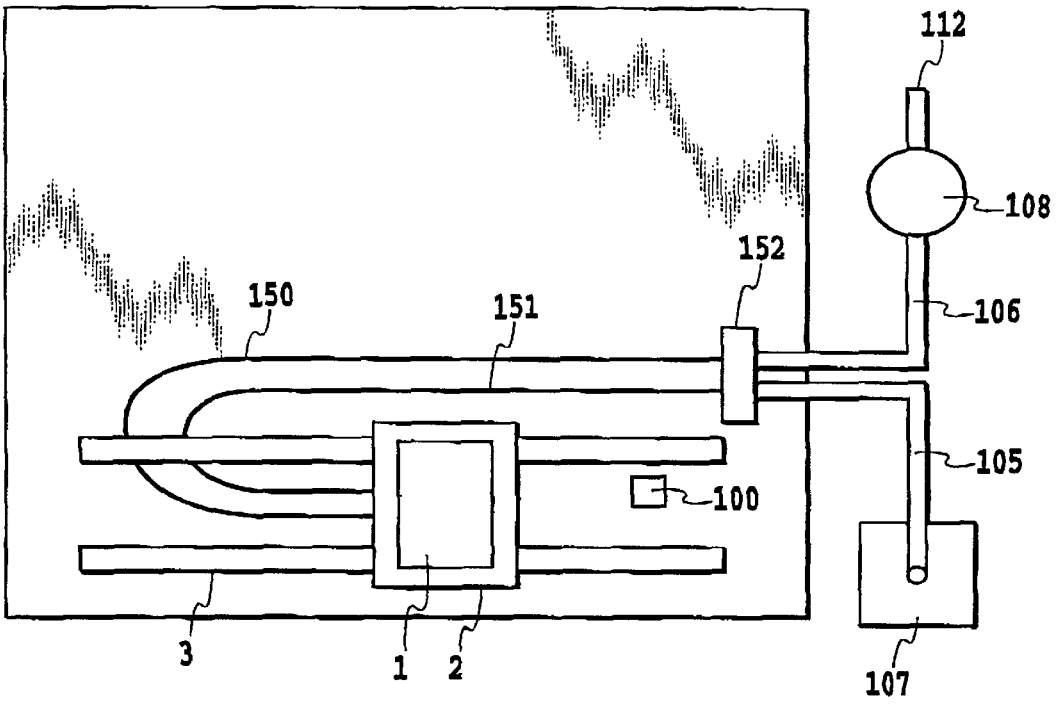
FIG. 2 is a schematic plan view showing a general structure of an inkjet printing apparatus employing an intermittent supply system utilizing a normally connected tube mechanism unlike the structure in FIG. 1.

FIG. 2 schematically shows an inkjet printing apparatus in which an intermittent supply system utilizing a normally connected tube mechanism is used. For simplicity, FIG. 2 does not show parts which can be configured similarly to those in FIG. 1 and which are not related to the description of the supply system of the present example.

In FIG. 2, reference numeral 150 represents a flexible tube for an air pressure circuit that is connected to a second ink tank of a printing head unit at one end thereof and connected to a pump unit 108 for pressurization and depressurization through an electromagnetic valve unit 152 and a tube member 106 for the air pressure circuit at another end thereof. Reference numeral 151 represents a flexible tube for supplying ink that is connected to the second ink tank of the printing head unit at one end thereof and connected to first ink tank 107 through the electromagnetic valve unit 152 and a tube member 105 for supplying ink at another end thereof.

That is, an intermittent supply system may be configured even using such a normally connected tube mechanism by interposing units for opening to form and closing to block a channel such as the electromagnetic valve unit 152 and by controlling the opening and closing of the same appropriately during an operation of charging the second ink tank with ink and a printing operation.

(Example of Structure of Control System)

Figure 3:
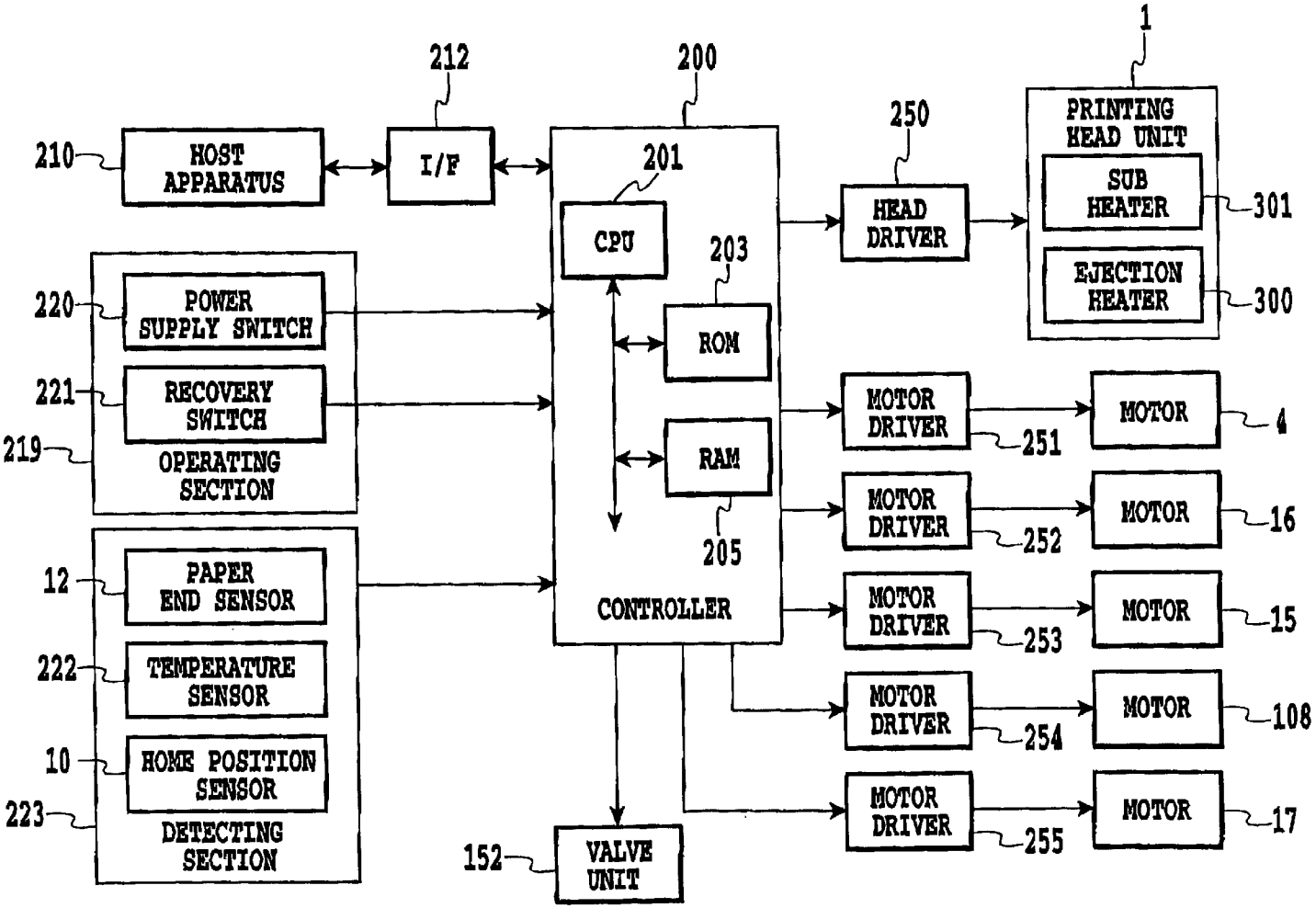
FIG. 3 is a block diagram showing an example of a schematic structure of a control system in the inkjet printing apparatus in FIG. 1 or FIG. 2.

FIG. 3 is a block diagram showing an example of a schematic structure of a control system in the inkjet printing apparatus in FIG. 1 or FIG. 2.

In FIG. 3, a controller 200 serves as a main control section and has a CPU 201 in the form of a microcomputer, a ROM 203 in which fixed data such as programs and required tables are stored, and a RAM 205 having areas such as an area for arranging image data and a work area, for example A host apparatus 210 is a supply source of image data which may be a computer for generating and processing data such as image to be printed and may alternatively be a reader for reading images or a digital camera. An inkjet printing apparatus according to the present embodiment or the invention may be configured separately from such a host apparatus 210 or may be configured integrally with the same in a separable or inseparable manner.

Image data, commands, and status signals are transmitted and received to and from the controller 200 through an interface 212. An operating section 219 has a power supply switch 220 and switches for accepting input of instructions of an operator such as recovery switch 221 for instructing activation of suction recovery. A detecting section 223 has sensors for detecting states of the apparatus such as the home position sensor 10 described above, a paper end sensor 12 for detecting the presence of a printing medium, and a temperature sensor 222 provided in an appropriate part for detecting the ambient temperature.

A head driver 250 is a driver for driving an electrothermal transducer (ejection heater) 300 of the printing head 1 according to printing data. The head driver 250 has a shift register for arranging printing data in association with the position of the ejection heater 300, a latch circuit for latching the arranged printing data at appropriate timing, a logic circuit element for actuating the ejection heater in synchronism with a drive timing signal, and a timing setting section for appropriately setting ejection heater drive timing (ejection timing) to perform registration of dot forming positions (a registration process) as needed. The printing head 1 is also provided with a sub-heater 301 for performing temperature adjustment in order to stabilize ink ejection characteristics. The sub-heater 301 may have a structure in which it is formed on a substrate of the printing head concurrently with the ejection heater 300 and/or a structure in which it is mounted to the printing head main body or printing head unit.

Reference numeral 251 represents a motor driver for driving the main scanning motor 4; reference numeral 252 represents a motor driver for driving the line feed (LF) motor 16; and reference numeral 253 represents a motor driver for driving the ASF motor 15. Reference numeral 254 represents a driver for driving and controlling the pump unit 108, and reference numeral 255 represents a motor driver for driving a motor 17 for operating the recovery system.

Reference numeral 38 represents a driver for driving a valve unit for opening and closing the channel. While it is not required when the valve units 101 and 104 are used which are coupled with and separated from each other to cause the channel to open and close automatically as in the example of structure in FIG. 1, is used in a structure in which the channel is passively opened and closed, i.e., when the electromagnetic valve 152 for opening and closing the ink channel is disposed as in the example of structure in FIG. 2.

(First Example of Structure of Intermittent Supply System)

A structure and a basic operation of an intermittent supply system of an inkjet printing apparatus according to the invention in its simplest form are described.

Figure 4:
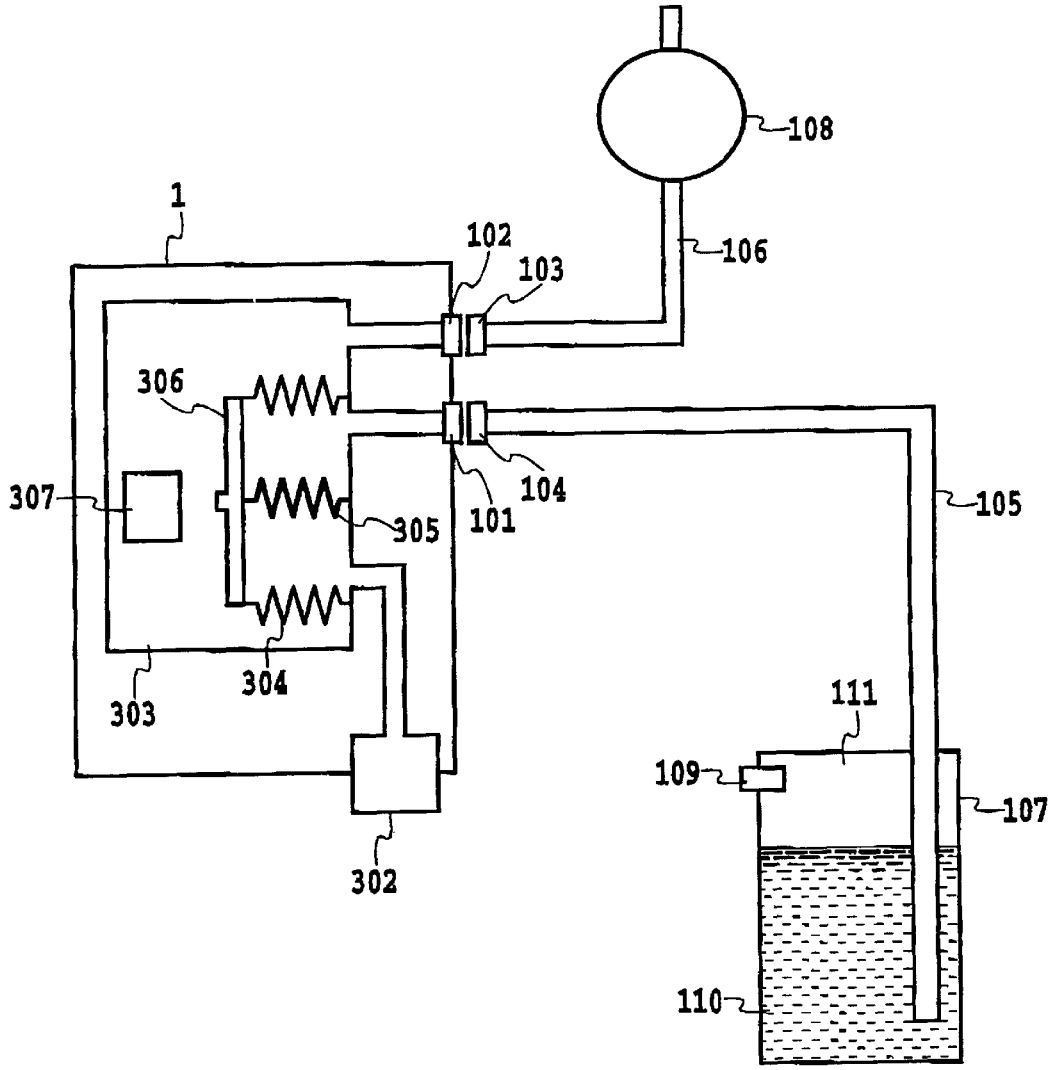
FIG. 4 is a schematic side view for explaining a first example of an internal structure of a printing head unit used for the intermittent supply system in the structure in FIG. 1 and connection circuits coupled with and located around the same.

FIG. 4 is an illustration for explaining an internal structure of a printing head unit 1 used for the intermittent supply system in the structure in FIG. 1 and connection circuits coupled with and located around the same. FIG. 4 shows the printing apparatus in its attitude or orientation during use, and the upside of the figure corresponds to upside in the vertical direction. The relationship between the heights of the first ink tank 107 and a second ink tank 304 is not limited to that illustrated here.

In FIG. 4, reference numeral 302 represents a printing head on which ejection openings or nozzles are arranged in a direction different from the main scanning direction (e.g., a direction orthogonal to the same) Ejection heaters are provided in liquid paths inside the ejection openings, and each of the liquid paths are in communication with a common liquid chamber to which ink may be introduced to distribute ink in each of the liquid paths.

Reference numeral 303 represents a shell element that is a structural body for blocking communication between such an internal structure and the atmosphere in regions other than the valve units 102 and 101. Reference numeral 304 represents a second ink tank. The second ink tank 304 is constituted by a structural body which is in the form of bellows for example and which has a flexible structure that can be displaced or deformed to have a variable internal volume in accordance with the pressure in the shell element 303. The second ink tank 304 is connected to the valve unit 101 with its interior in communication with the common liquid chamber of the printing head 302 In an attitude or orientation in use, the part connected to the valve unit 101 is in a position higher than the part in communication with the printing head 302 in the direction of gravity. In the illustrated example, in the attitude in use, the part connected to the valve unit 101 and the part in communication with the printing head 302 are in the highest and lowest positions respectively in the direction of gravity. Reference numeral 306 represents an abutting member provided at a displaced section of the structural body of the second ink tank 304. Reference numeral 307 represents a stopper which contacts the abutting member 306 when the member 306 is displaced as a result of an increase (expansion) of the internal volume of the second ink tank 304 to prevent further displacement, thereby regulating the increase of the internal volume of the second ink tank 304.

Reference numeral 305 represents a compression spring that is coupled with each of the abutting member 306 of the second ink tank 304 and the shell element 303 at an end thereof and that is set such that it exerts a force in the expanding direction or the direction of increasing the internal volume of the second ink tank 304. While the spring 305 is disposed in the second ink tank 304 in the illustrated example, it may be provided outside the same. In this case, either compression spring or tension spring may be used as long as it can exert a force in the direction of increasing the internal volume of the second ink tank 304. Instead of providing such a special spring, the material and structure of the second ink tank 304 may be appropriately selected, i.e., the bellows may be constituted by a rubber member for example to provide the second ink tank 304 with a structure which generates a negative pressure therein by itself and which can be displaced or deformed in the direction of increasing the internal volume.

The interior of the second ink tank 304 is put in communication with the first ink tank 107 through the tube member 105 when the valve units 101 and 104 are connected. A space inside the shell element 303 and outside the second ink tank 304 is coupled with the pump unit 108 through the tube member 106 when the valve units 102 and 103 are connected. The valve units 101 and 104 have a structure in which they form an ink channel when coupled with each other and close the same in an uncoupled state.

Figure 5A:
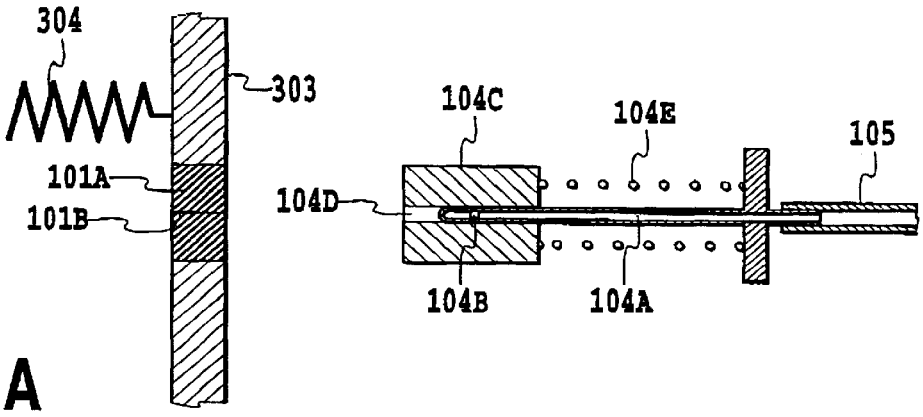
FIGS. 5A, 5B, and 5C are illustrations for explaining an example of a structure and operation of valve units for supplying ink that can be used in the structure in FIG. 4.
Figure 5B:
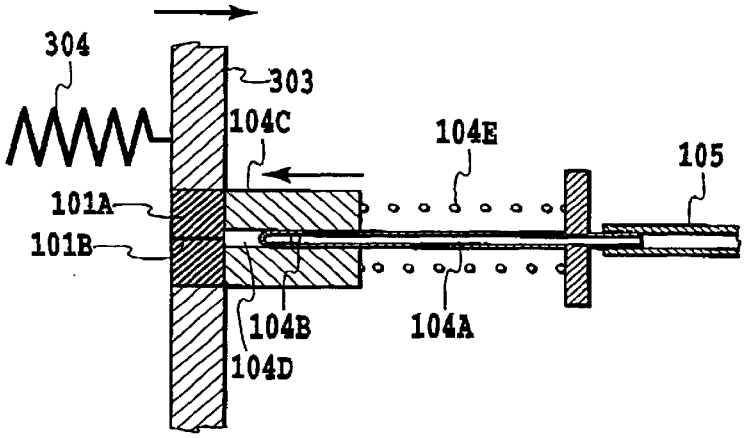
Figure 5C:
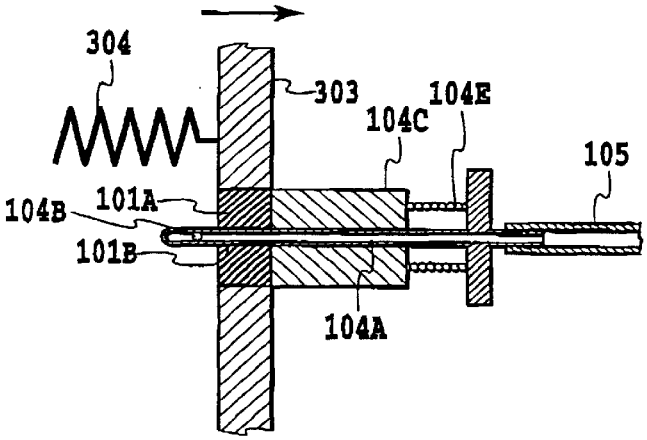

FIGS. 5A, 5B, and 5C are illustrations for explaining the structure and operation of the valve units 101 and 104.

In FIG. 5A, reference numeral 101A represents a sealing member that forms a part of the valve unit 101 and that is constituted by an elastic member such as rubber for sealing the interior of the ink tank 304, and a slit 101B is provided which is continuously extends between the inside and outside of the second ink tank 304. When the illustrated state in which the valve units 101 and 104 are not coupled, the slit 101B is closed by the elasticity of the sealing member 101A itself to keep the interior of the ink tank 304 in a gas-tight and liquid-tight state.

Reference numerals 104A through 104E represent members of which the valve unit 104 is made up. Reference numeral 104A represents a hollow needle member which is provided at an end of the tube member 105 and which has an opening 104B on a side in the vicinity of a tip end. Reference numeral 104C represents a closing member which covers the tip portion of the hollow needle member 104A including the opening 104B and which is constituted by an elastic member such as rubber having a through hole 104D into which the hollow needle member 104A is fitted. The closing member 104C is urged by a spring 104E provided at a flange portion of the hollow needle 104A It is held in the illustrated position when the valve units 101 and 104 are in the uncoupled state, and the opening 104B of the hollow needle member 104A is closed by an inner wall of the through hole 104D.

When the shell 303 moves rightward in the figure for a charging operation from such a state in FIG. 5A, the sealing member 101A and the closing member 104C contact each other as shown in FIG. 5B.

When the shell element 303 further moves rightward in the figure, as shown in FIG. 5C, the spring 104E is compressed, and the tip of the hollow needle member 104A proceeds in the through hole 104D in a relative manner and enters the second ink tank 304 while expanding the slit 101B by force, by which the opening 104B is located inside the second ink tank 304 This establishes communication between the first ink tank 107 and the second ink tank 304 through the tube member 105.

When the shell element 303 moves leftward in the figure after the charging operation is completed, the state shown in FIG. 5A is restored in which ink will not leak regardless of the attitude of the printing apparatus because the interiors of the second ink tank 304 and the first ink tank 107 are in a liquid tight state.

Obviously, the example in FIGS. 5A, 5B, and 5C is not limiting the invention, and various structures may be employed for the valve units 101 and 104 which thus form a channel in a coupled state and closes the same in an uncoupled state.

Unlike such valve units 101 and 104, the valve units 102 and 103 have no valve member to close the channel when they are disconnected. In particular, the space inside the shell member 303 and outside the second ink tank 304 is exposed to the atmosphere when they are disconnected.

Referring to FIG. 4 again, the pump unit 108 may have a pump main body in the form of a diaphragm pump, for example, and a directional control valve which is connected to an action chamber of the pump main body and which can switch a channel between the atmosphere and the valve unit 103. In the coupled state of the valve units 102 and 103, the pressure in the shell element 303 can be increased by first performing a sucking operation with the channel set in the position of the atmosphere and then performing an ejecting operation with the channel set in the position of the valve unit or shell element. Conversely, the pressure in the shell element 303 can be reduced by performing a suction operation with the channel set in the position of the valve unit or shell element and then performing an ejecting operation with the channel set in the position of the atmosphere. Obviously, the pump unit 108 may have any structure as long as it can appropriately increase or reduce the pressure in the shell element 303. In the present embodiment, depressurization is carried out by sucking air from the shell element 303 using the pump unit 108, and pressurization is carried out by forcing pressurized air into the shell element 303. Alternatively, a predetermined gas or liquid may be enclosed in the shell element 303 and a depressurizing force or pressurizing force may be applied to the same.

While various structures are possible for the first ink tank 107 for reserving ink 110 to be supplied to the second ink tank 304 or printing head 302, the tank in the present embodiment has an atmosphere communication section 109 to always keep the pressure therein at the atmospheric pressure through communication with the atmosphere. While the atmosphere communication section 109 may be a simple hole as long as it is in a position higher than the ink level, the hole may be provided with a functional film that allows only gases to pass and disallows liquids to pass from the viewpoint of more effective prevention of leakage of ink. The tip of the tube member 105 that is stuck into the first ink tank to transport ink is located at its lowest position in the ink tank in the direction of gravity in the attitude in use as illustrated. This structure is not only helpful in using up ink without any residue but also advantageous for a process for eliminating air in the second ink tank 304 as will be described later.

In the structure of the present embodiment, the first ink tank 107 and the second ink tank 304 have no sponge such that ink is contained in the spaces therein as it is. This provides a structure in which ink and a gas can be quickly separated from each other downward and upward respectively in the direction of gravity without any obstacle.

(Example of Ink Charging Process)

Figure 6:
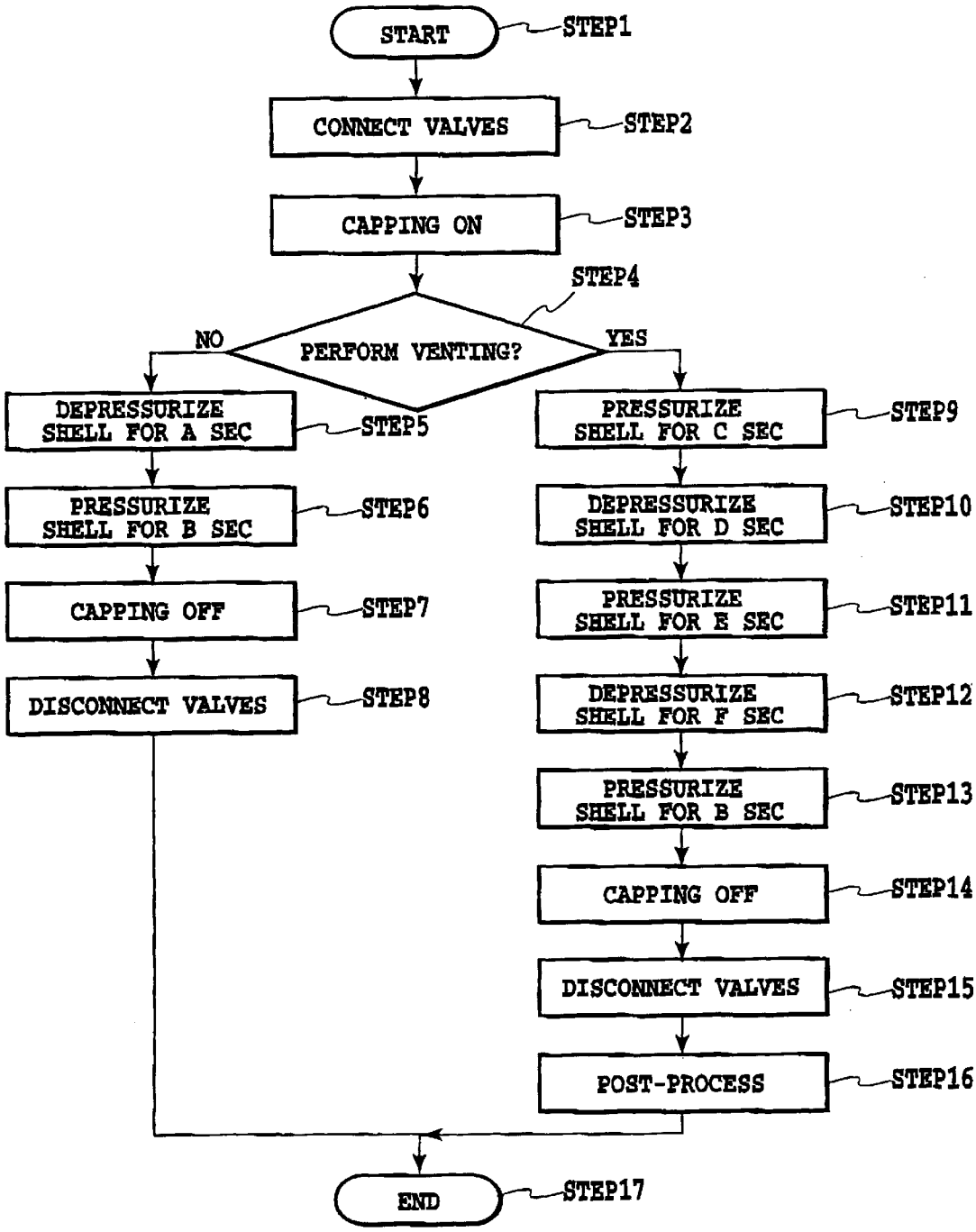
FIG. 6 is a flow chart showing an example of a processing procedure for charging ink from a first ink tank to a second ink tank in the structure in FIG. 1.

FIG. 6 shows an example of a processing procedure for charging ink from the first ink tank 107 to the second ink tank 304 in the above structure.

For example, when image data are supplied and printing is instructed by the host apparatus 210 to activate the procedure (Step 1), an operation of connecting the valve units 101 through 104 is performed at Step 2. That is, the carriage 2 is moved in the main scanning direction in the structure in FIG. 1 to cause the valve units 101 and 102 to abut on the valve units 104 and 103 respectively, thereby forming an ink channel and an air channel. The invention is not limited to this method of connection. The channels in the valve units 101 and 104 are closed until they are connected, and both of the channels are opened and coupled with each other at the time of connection. The valve units 102 and 103 are always open, and an air channel is formed as they are coupled.

A capping operation is then performed at Step 3. This is an operation of moving the cap section of the recovery system mechanism indicated by reference numeral 100 in FIG. 1 to put it in tight contact with the surface of the printing head 302 in FIG. 4 where ejection openings are formed.

At Step 4, it is judged whether to perform a process of discharging air or gases accumulated in the second ink tank (hereinafter referred to as a venting process), and the process branches to subsequent operations according to the judgment. A basic condition that determines branching is elapsed time since the previous venting process, the number of operations of charging the second ink tank 304 with ink, or relationship between such factors.

Figure 7:
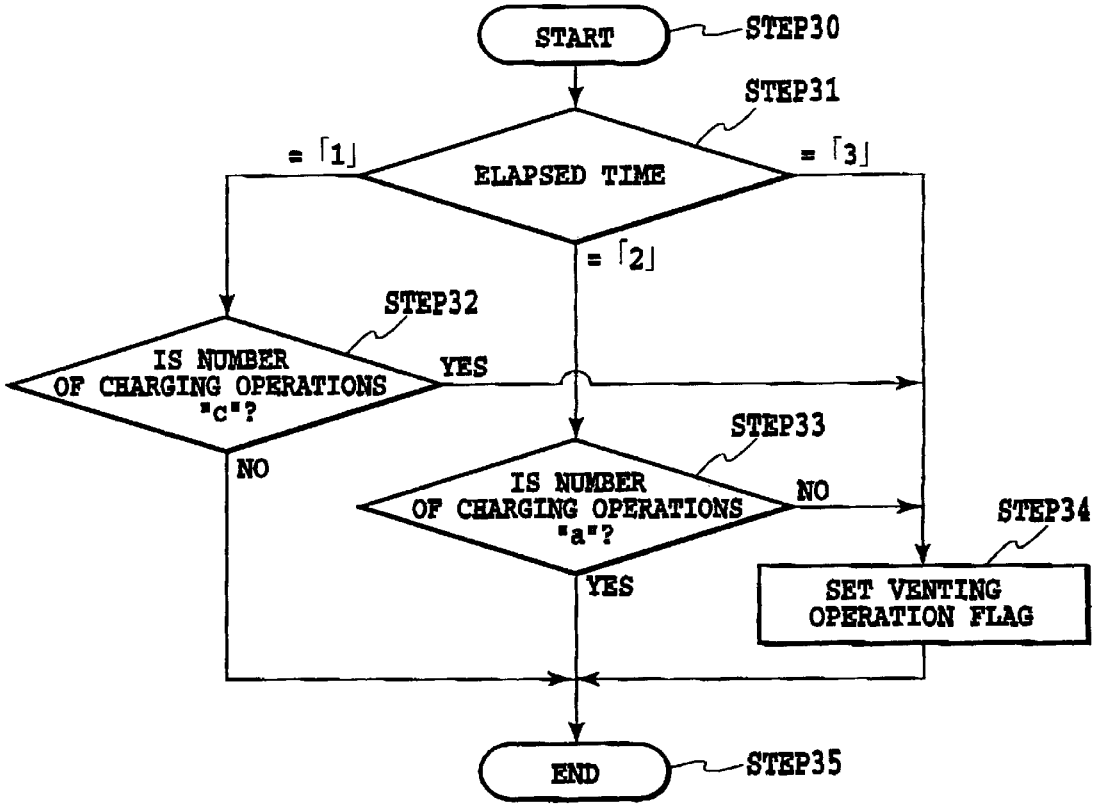
FIG. 7 is a flow chart showing a detailed example of a process for a judging procedure for judging whether to perform a venting process included in the procedure in FIG. 6.

FIG. 7 shows an example of a processing procedure for making the judgment on whether to perform the venting process. When the judging process is started (Step 30), the process is branched at Step 31 by acquiring information on the elapsed time since the last venting process performed on the second ink tank. The present procedure uses three kinds of information for judgment, i.e., elapsed time less than one week that is represented by "1", elapsed time of one week or more and less than one month that is represented by "2", and elapsed time of one month or more that is represented by "3". For example, a timer provided on the printing apparatus or host apparatus may be restarted each time a venting process is performed, and the process may be branched according to the time measured since the time of restarting. Alternatively, the process may be branched by using a calendar function and a memory area in which the time of each venting process is held as an update and by comparing the current time indicated by the calendar function and the time of the last venting process stored in the memory area. In this case, it is preferable to use an area of a non-volatile memory such as an EEPROM whose contents are maintained even when the power supply of the printing apparatus is turned off.

When the elapsed time information is "3", a flag for performing a venting operation is set at Step 34. For example, the flag may be formed in an area of a part of the RAM 205. Since a venting process is performed when the flag is set, the timer may be restarted at such a point in time. After branching occurs based on a judgment that the elapsed time information is "1" or "2",it is determined whether a venting process is required or not based on the number of times the operation of charging the second ink tank 304 with ink is repeated since the last venting process. Referring to levels of the number of charging operations, in the present procedure, a level "a" corresponds to less than 10 times; a level "b" corresponds to 10 times or more and less than 20 times; and a level "c" corresponds to 20 times or more. A memory area may be used to store a cumulative number of charging operations, and it is preferable to use an area of a non-volatile memory such as an EEPROM whose contents are maintained even when the power supply of the printing apparatus is turned off.

When the elapsed time information is "1", it is judged at Step 32 whether the number of charging operations is at the level "c" or 20 or more. If the judgment is negative, the present procedure is terminated. If the judgment is affirmative, the procedure proceeds to Step 34 at which the flag for performing a venting operation is set and the present procedure is terminated. When the elapsed time information is "2", it is judged at Step 33 whether the number of charging operations is at the level "a" or less than 10. If the judgment is negative, the procedure proceeds to Step 34 at which the flag for performing a venting operation is set. If the judgment is affirmative, the present procedure is terminated.

After the flag for performing a venting operation is set at Step 34, the present procedure is terminated (Step 35), and the process returns to Step 4 in FIG. 3 at which a venting process (Steps 9 to 15) is performed based on the judgment that the flag is set. When the judgment at Step 32 is negative or when the judgment at Step 33 is affirmative, the present procedure is immediately terminated (Step 35), and the process returns to Step 4 at which a normal charging process (Steps 5 to 8).

While it is judged whether a venting process is required based on elapsed time and the number of charging operations in the present embodiment, either of the conditions is sufficient as long as a venting process is properly activated. Further, the condition for judgment may be varied taking conditions such as the ambient temperature and humidity into consideration and may be changed and optimized in consideration to factors such as the type of ink, the size of the second ink tank, the flow rate of ink ejected from the printing head per unit time, and the attitude in use. Obviously, the values shown above with respect to elapsed time and the number of charging operations are merely example.

Referring to FIG. 6 again, when the venting process flag is set and it is therefore judged at Step 4 that a venting process is to be performed, the procedure proceeds to Step 9. At Step 9, the pump unit 108 for pressurization and depressurization is operated to perform pressurization. The pressurizing operation continues for a predetermined time (C seconds). The predetermined time for the pressurizing operation is basically set at a time that is sufficient to minimize the internal volume of the second ink tank 304 and that normally ranges from about 3 to 10 seconds depending on the dimensions of various elements.

It is not always necessary to minimize the internal volume of the second ink tank 304 completely in performing a venting process, the pressurizing time may be changed to or set at a required minimum value by estimating the amount of residual air from parameters such as elapsed time and the number of charging operations. In any case, however, it is desirable to satisfy a pressurizing condition that pressurization is to be performed with a force within an ability to hold meniscuses formed at the nozzles of the printing head (meniscus holding ability). With a force equal to or smaller than the meniscus holding ability, a pressurizing operation can be performed without leakage of ink from the nozzles. In the present embodiment, however, since capping is provided on the surface of the printing head on which the ejection openings are formed, a pressurizing operation can be performed with a pressure higher than the meniscus holding ability for a short time. In order to cause ink to flow back to the first ink tank 107 in a short time by performing a pressurizing operation with a force within the meniscus holding ability during pressurization, it is desirable that the channel has a small pressure loss attributable to the reverse flow.

The procedure then proceeds to Step 10 at which the pump unit 108 is operated for depressurization this time. Since the depressurizing operation puts the interior of the shell element 303 under a pressure that is lower than the atmosphere, ink flows from the first ink tank 107 into the second ink tank 304 through the tube member 105 and the valve units 104 and 101. The pressure during the depressurizing operation is also preferably within a meniscus holding ability during depressurization, which makes it possible to prevent air from entering through the ejection openings. When the depressurizing operation is continued for a predetermined time (D seconds), the second ink tank 304 expands to a position where the abutting member 306 abuts on the stopper 307, and the abutment of those members mechanically prevents any further expansion.

The procedure then proceeds to Step 11 at which the interior of the shell element 303 is pressurized again for a predetermined time (E seconds). Next, the interior of the shell element 303 is depressurized again for a predetermined time (F seconds) at Step 12. This is an operation required to return the entire air in the second ink tank 304 to the first ink tank 107. On the contrary, when it is not necessary to always keep maximum ink charging efficiency by pushing back the air in the second ink tank 304 completely, the second pressurizing and depressurizing operations (Steps 11 and 12) maybe omitted.

A condition for completing discharging the air in the second ink tank 304 is to provide a structure that satisfies a relationship expressed by:

Maximum internal volume (or maximum discharge capacity) of second ink tank 304

>(Internal volume of tube member 105)×2

The relationship is realized by repeating the pressurizing and depressurizing operations at least twice. This is one of features of the present embodiment.

That is, when the second ink tank 304 is completely filled with air, even if the pressurization operation is performed at Step 9 to push out the air toward the ink tank 107 substantially entirely, air in an amount equivalent to the internal volume of the tube member 105 returns to the second ink tank 304 during the depressurizing operation at Step 10. When the second pressurizing operation is then performed at Step 11, air that has resided in an upper part of the interior of the second ink tank 304 in the direction of gravity returns to the first ink tank 107, and ink returns after the entire residual air returns.

If it is not necessary to discharge the air completely at all times, what is required is only to satisfy a relationship expressed by:

Maximum internal volume (or maximum discharge capacity) of second ink tank 304

>Internal volume of tube member 105

However, when the relationship that "the maximum internal volume (or maximum discharge capacity) of the second ink tank 304>(internal volume of the tube member 105)×2" is satisfied, the interior of the tube member 105 is inevitably filled with ink that has returned later at the time of the second operation. Therefore, when the second charging operation is performed at Step 12, only ink flows into the second ink tank 304. The above-described operation completely fills the second ink tank 304 with ink.

In this state, since the abutting member 306 of the second ink tank 304 abuts on the stopper 307 in practice, the compression spring 305 cannot freely expand. Then, a pressurizing operation is performed again for a short time (B seconds) at Step 13 to push a small amount of the ink in the second ink tank 304 back to the first ink tank 107, which causes contraction of the second ink tank 304 to space the abutting member 30 from the stopper 307, thereby allowing a proper negative pressure to be generated by the compression spring 305.

The pressure generated at this time is preferably within the meniscus holding ability of the printing head in order to generate no waste ink at all. The pressure may be conversely increased to allow a small amount of ink to flow out the nozzles to positively utilize the same also for a recovery process for achieving good ink ejecting characteristics of the printing head.

Instead of performing such a pressurizing operation at Step 13, the time of the depressurizing operation at Step 12 may be appropriately set such that the depressurizing operation stops before the abutting member 306 abuts on the stopper 307 completely. Alternatively, it may be stopped by detecting the position of the abutting member with a sensor. A process may be performed to suck a small amount of ink from the ejection openings of the printing head through the cap. Alternatively, ink may be ejected into the cap (preliminary ejection) by driving the printing head.

In any case, the compression spring 305 becomes displaceable in the direction of increasing the internal volume to produce a negative pressure as a result of such a process to space the abutting member 306 from the stopper 307. In this state, the expansion of the second ink tank is stopped in equilibrium with the meniscus holding ability of the printing head. It is therefore desirable to set the spring constant of the compression spring 305 such that the negative pressure is kept in a range of optimum values at which ink can be properly ejected from the printing head while ink is consumed from such a state until the internal volume of the second ink tank 304 is minimized.

Next, the capping state achieved by the recovery system mechanism 100 is canceled at Step 14, and the carriage 2 is moved toward the printing area in the main scanning direction to decouple the valve units at Step 15. At this time, both of the valve units 101 and 104 operate to close the channel, and the valve unit 102 is left in the open state.

Further, post-processes are performed to restart the timer for judging elapsed time since the last venting process (or to update the information of the time of the venting process), to clear the information of the number of charging operations, and to reset the venting process judgment flag (Step 16), and the process is then terminated (Step 17).

On the contrary, when the venting process flag is not set and it is judged that the venting operation is not required at Step 4, the procedure proceeds to Step 5. In this case, since no air or only a very small amount of air resides in the second ink tank 304, the interior of the shell element 303 is depressurized for a predetermined time (A seconds) with the pump unit 108 for pressurization and depressurization to immediately start expanding the second ink tank 304 which has contracted to a small internal volume as a result of ink consumption.

Next, the pressurizing operation is performed for a short time (B seconds) at Step 6 to return a small amount of ink to the first ink tank to allow a proper negative pressure to be generated by the compression spring 305. Next, the capping state achieved by the recovery system mechanism 100 is canceled at Step 7, and the carriage 2 is then moved toward the printing area in the main scanning direction at Step 8 to decouple the valve units, which terminates the process (Step 17). The processes at Steps 6 to 8 are similar to the processes at Steps 13 to 15.

With the above structure and processes make it possible to supply ink to the second ink tank intermittently in a simple manner without generating waste ink as a result of a charging operation.

The internal volume of the second ink tank 304 can be varied, and the second ink tank 304 functions as an actuator for charging ink, performing a venting process, and returning ink to the first ink tank by changing its interval volume. Thus, those operations can be performed by driving and controlling a single source of driving. Other advantages include the followings. In an on-demand type inkjet system in the related art, ink flows from an ink tank toward a printing head on a unidirectional basis. The present embodiment is characterized in that ink flows in a single channel on a bi-directional basis. In particular, when dye ink or pigment ink is left in the second ink tank or tube for a long time, problems arise in that the viscosity of ink increases because of evaporation of moisture or components of the solvent to cause clogging more easily and to result in an increase in the density which is likely to cause imbalance between colors of an image. In such a case, in the system of the related art, since ink flows on a unidirectional basis, the entire ink in the tube or the second ink tank must be abandoned as waste ink to solve the problem, which results in wasteful consumption of a great amount of ink. On the contrary, according to the present embodiment, ink in the second ink tank or tube can be restored to a recyclable condition by returning it to the first ink tank having a relatively large capacity and re-diffusing it in ink in a normal condition that has not been evaporated. Such an operation can be performed in accordance with the period for which the ink has been left behind, the parameters in the flow chart in FIG. 7 may be determined from such a point of view.

Figure 8:
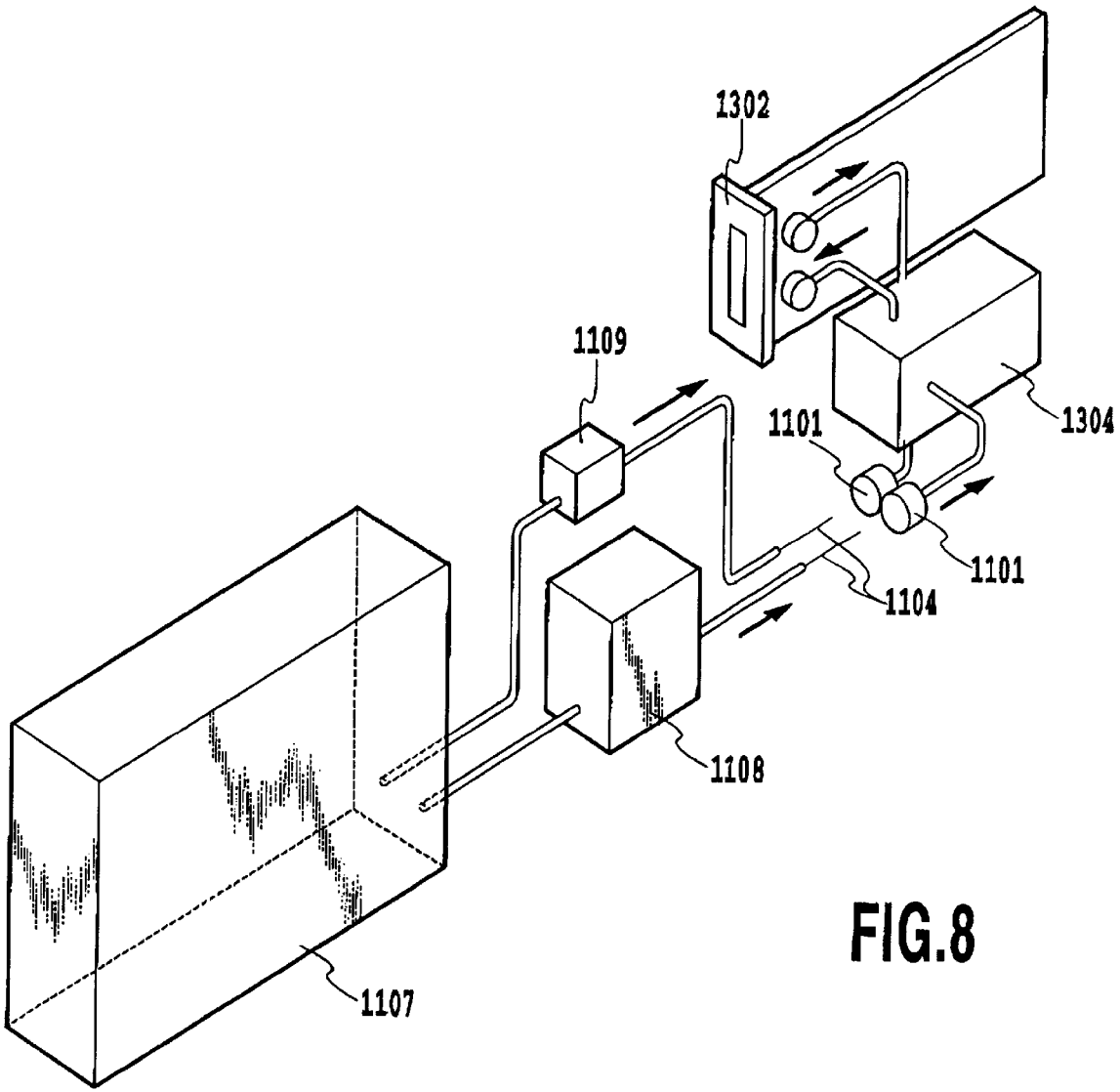
FIG. 8 shows an example for comparison with the structure in FIG. 4.

A supply system as shown in FIG. 8 may be adopted as a structure in which ink in the second ink tank or tube can be restored to a recyclable condition or vented by returning it to the first ink tank having a relatively large capacity and re-diffusing it in ink in a normal condition that has not been evaporated.

In FIG. 8, reference numerals 1101 and 1104 represents connecting sections at a first ink tank 1107 and a second ink tank 1304, respectively, those portions are elements of an intermittent supply system that is connected on demand during operations such as an ink charging operation. In the structure in FIG. 8, such connecting sections are provided for supplying ink to the second ink tank 1304 and for returning ink to the first ink tank 1107. Reference numeral 1108 represents a pump provided in a supply path extending from the first ink tank 1107 to the second ink tank 1304 and reference numeral 1109 represents a valve provided in a return path extending from the second ink tank 1304 to the first ink tank 1107.

In such a structure, when the valve 1109 is opened and the pump 1108 is actuated with the first ink tank 1107 and the second ink tank 1304 connected through the connecting sections, ink is supplied from the first ink tank 1107 to the second ink tank and a printing head 1302 and is returned from the printing head 1302 or the second ink tank 1304 to the first ink tank 1107. That is, a circulating ink supply system is formed between the first ink tank 1107 and the second ink tank 1304 or the printing head 1302. As a result of such circulation, the second ink tank 1304 is charged with ink, ink in the second ink tank 1304 or a tube can be returned to the first ink tank 1107 to be refreshed or vented.

However, since the structure in FIG. 8 forms a circulating system, the internal volume of the second ink tank 1304 is not variable, and some measures must be taken to apply a negative pressure to the printing head 1302 properly. When a porous body as an element for generating a negative pressure is disposed in the second ink tank 1304, a problem arises in that it sets a limit on ink containing efficiency. In order to reserve ink as it is without providing such a porous body, the second ink tank 1304 must be disposed in a position lower than the printing head 1302 to generate a negative pressure, which results in the same problem as that occurs between a first ink tank and a printing head in a continuous supply system when the printing apparatus is configured as a portable type because of unstable attitude.

On the contrary, the structure of the present embodiment makes it possible to solve such a problem because a structure is adopted in which the internal volume of the second ink tank 304 can be varied to generate an adequate negative pressure and because the structure makes it possible to charge ink, to perform a venting process, or to return ink to the first ink tank by changing the internal volume appropriately.

Since ink and air flow in the same path on a bi-directional basis, it is possible to simplify the structure of connecting members such as a tube and steps for connecting the same.

(Structure of First Ink Tank)

As described above, the tip of the tube member 105 to be stuck into the first ink tank is located at the lowest position in the ink tank in the direction of gravity in the attitude in use shown in FIG. 4. This is a structure effective not only in using up ink without any residue but also in performing a process of venting the interior of the second ink tank 304.

That is, in the present embodiment, the pressurizing operation at Step 9 causes a reverse flow of ink and air from the second ink tank 304 to the first ink tank 107 through the tube member 105. Therefore, it is most important that the tip of the tube member 105 is located at the lowest position in the ink tank with the air 111 residing above the ink 110 in a separated state in the first ink tank 107 as shown in FIG. 4. That is, ink containing air that has been once subjected to a reverse flow is separated into ink and air again in the first ink tank by the action of gravity to reuse the ink. This makes it possible to complete an intermittent supply system without generating waste ink, which is one of important teachings of the invention. That is, the present embodiment is featured by a structure which makes it possible to reuse such an ink that is abandoned as waste ink in the conventional structure.

Referring to design conditions that the first ink tank must satisfy in this regard, the ink outlet port (the tip of the tube member) is located close to the bottom of the ink reservoir (in the lower side of the same in the direction of gravity) in the attitude or orientation for normal use, and the tank has a structure in which air and ink can always reside in higher and lower positions, respectively, relative to each other in the direction of gravity in a separated state in the attitude for normal use. Other conditions to be preferably satisfied are as follows. At the beginning of the initial use of the tank, more exactly speaking, at the point in time when the first reverse flow occurs after the initial use of the tank is started, the tank has a capacity to accept the amount of the first reverse flow (the amount of air and ink that have resided in the second ink tank at that point in time). There is a structure or element that always keeps the interior of the first ink tank substantially at the atmospheric pressure. At least the first ink tank section is a type that can be replaced independently of the printing head. In this case, in order to facilitate the replacement of the first ink tank, the tube member 105 may be constituted by tube elements that can be separated each other in the vicinity of the first ink tank 107.

The first ink tank is not limited to the structure shown in FIG. 4, and various structures may be adopted for the same provided that the above conditions are appropriately met.

Figure 9:
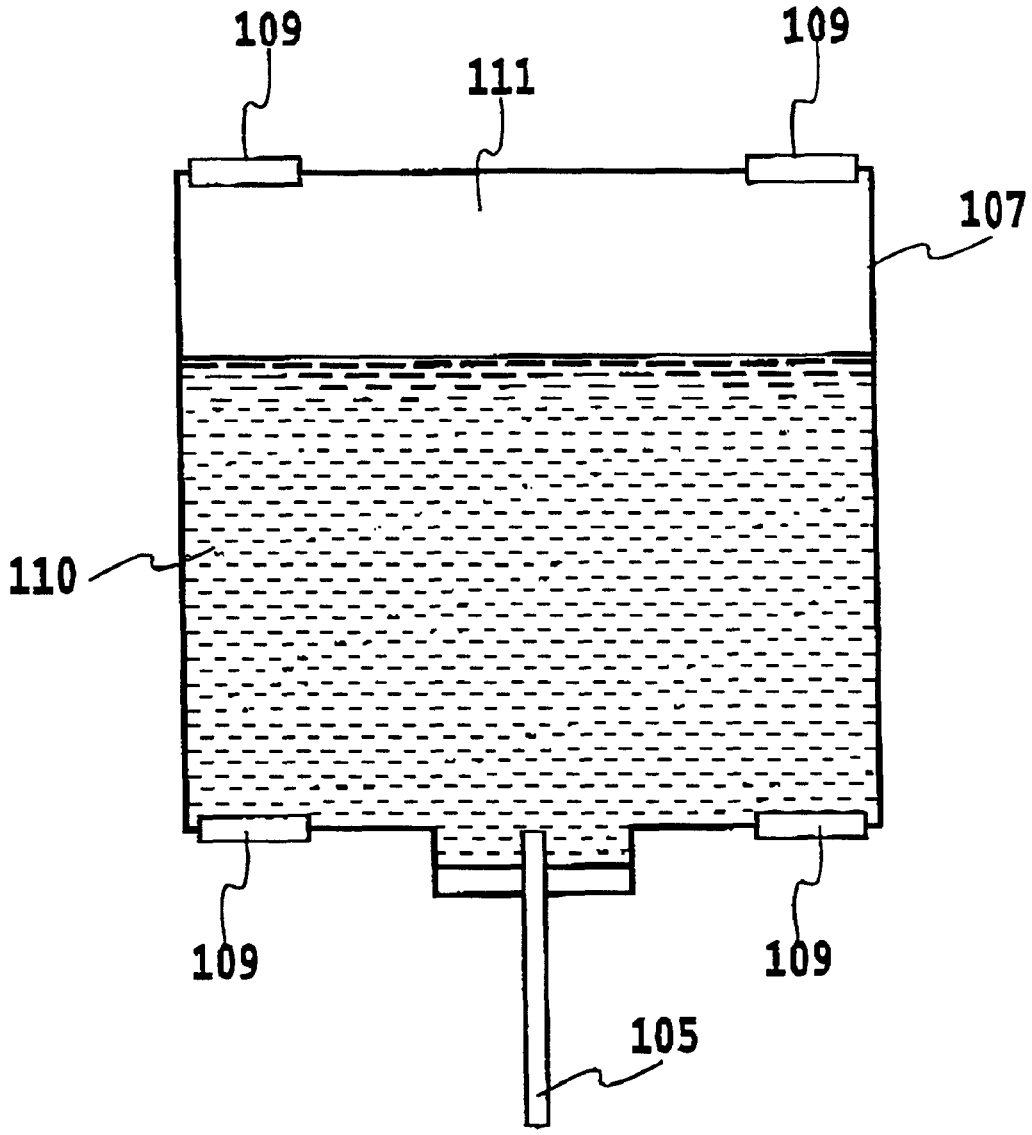
FIG. 9 is a schematic side view showing another example of a structure of the first ink tank that can be used in the embodiment of the invention.

FIG. 9 shows another example of a structure of the first ink tank 107 that can be used with the invention. The basic principle and operation of the ink tank is substantially the same as those shown in FIG. 4 except that a tube member 105 is coupled to a part that is the bottom of the same in its attitude for normal use; the tip of the tube member is stuck into the tank in such an amount that it stays in the bottom region; and a plurality of atmosphere communication sections 109 each having a functional film are provided in appropriate regions such as the top region and the bottom region such that some of the sections are always located in positions higher than the level of ink in any attitude of the tank.

Figure 10:
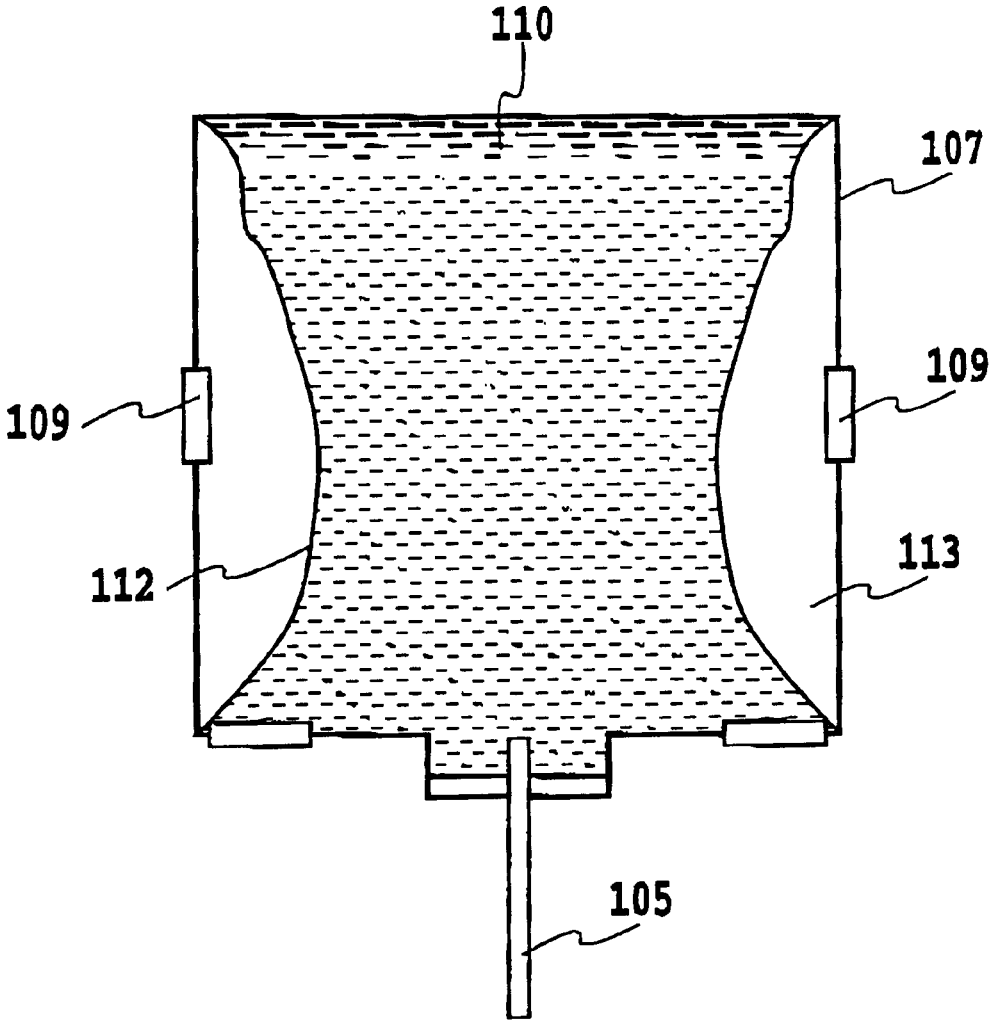
FIG. 10 is a schematic side view showing another example of a structure of the first ink tank that can be used in the embodiment of the invention.

FIG. 10 shows still another example of a structure of the first ink tank 107. The present example has a structure in which deformable film members are applied to the interior of the housing of the first ink tank 107. That is, elements indicated by reference numeral 112 are the deformable films, and two such films are used here. Reference numeral 113 represents spaces that allow volumes inside the films to be increased (expansion of spaces in the films).

When ink containing air flows back into ink 110 through the tube member 105 in this structure, the deformable films 112 are deformed in the spaces 113, and the reverse flow can be thus accepted. In this case, the pressure in the first ink tank 107 is balanced with the atmospheric pressure by the atmosphere communication sections 109 and will not become an extreme positive pressure. In this case, however, since air is accumulated in the ink 110 as a result of the reverse flow unlike the case of the structure in FIG. 9, a design with an adequate volume ratio is strongly desired such that any expansion of air according to a temperature change can be accommodated in the spaces 112.

(Second Embodiment)

Figure 11:
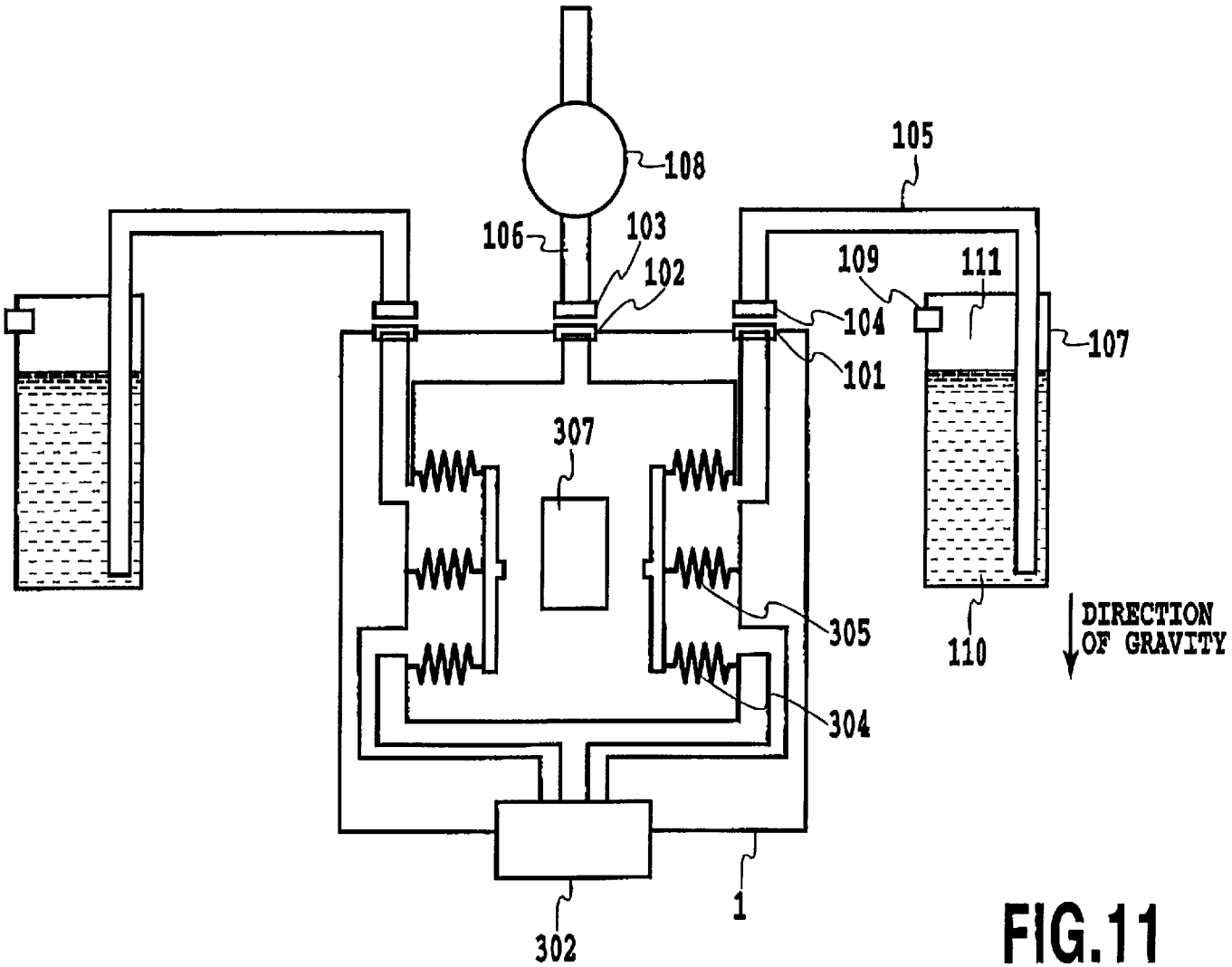
FIG. 11 is a schematic side view for explaining a second example of an internal structure of a printing head unit used for an intermittent supply system.

FIG. 11 shows a second embodiment of the invention. While an intermittent supply system for one type of ink is configured in the above embodiment, the present embodiment is presented to describe an intermittent supply system configured for two or more types or colors of inks. That is, while FIG. 11 shows an example of a structure to allow the use of two types of inks for simplicity, it is obvious that an intermittent supply system can be configured to allow the use of more types of inks, e.g., four or six types of inks based on the same idea.

The present embodiment has the following advantages in addition to the fact that a plurality of systems (two systems in the illustrated example) is provided unlike the above embodiment. A mechanism (pump unit 108) for pressurization and depressurization and a shell element can be basically used commonly, which is suitable for a design of a more compact printing apparatus. Common peripheral mechanisms can be used even when it is required to use second ink tanks having different sizes that depend on colors or types of inks used in a printing apparatus. Second ink tanks having remaining inks in different amounts can be charged at a high speed by adjusting the amounts of all types of inks to respective optimum values using a control sequence for a single pump unit without performing individualized control.

That is, a control sequence that is substantially the same as the processing procedure shown in FIG. 6 can be used only by making changes such that the judging process at Step 4 and the judging procedure in FIG. 7 is carried out for each type of ink and such that the process proceeds to Step 9 when there is any second ink tank for which a venting process is required and otherwise proceeds to Step 5.

Figure 12A:
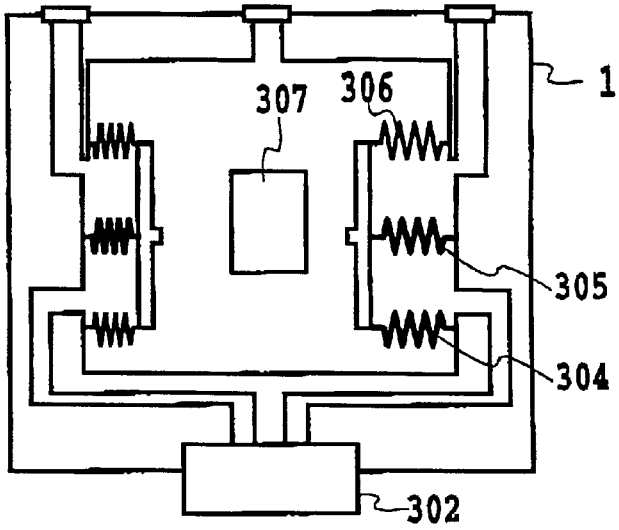
FIGS. 12A, 12B and 12C are illustrations for explaining operations sequentially performed when ink is charged in the structure in FIG. 10.
Figure 12B:
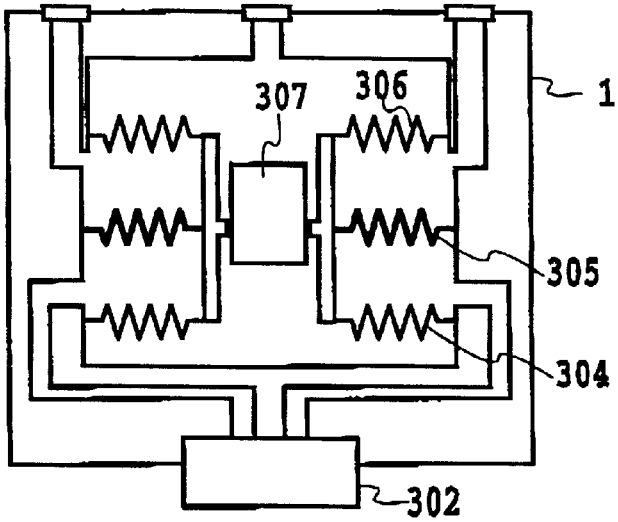
Figure 12C:
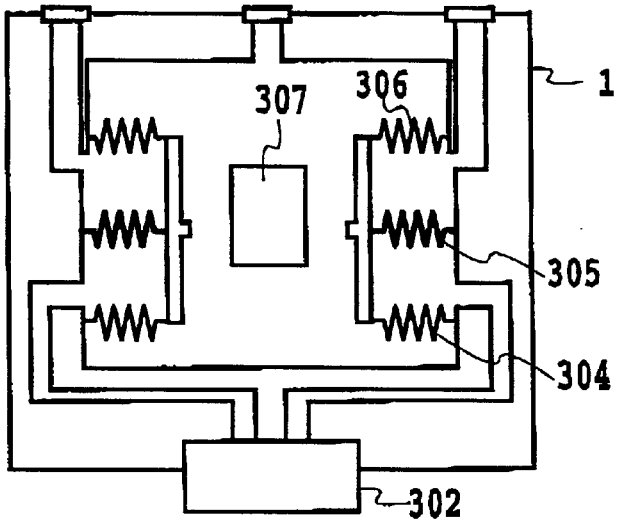

An ink charging operation in the present embodiment will be described with reference to FIGS. 12A, 12B, and 12C. FIGS. 12A, 12B, and 12C show actions of the second ink tanks at respective phases of an ink charging operation that is performed on the second ink tanks having different internal volumes between the ink types. FIG. 12A shows a state in which remaining amounts of inks are not balanced between the ink types before the ink charging operation is started. FIG. 12B shows a state after depressurization in which each abutting member 306 abuts on a stopper 307 to stop the charging at a prescribed amount. FIG. 12C shows a state after the charging operation in which a reverse flow of a small amount of ink is caused by performing pressurization for a short time to space each abutting member 306 from the stopper 307 on which the member has abutted, thereby allowing an adequate negative pressure to be generated by each compression spring 305.

The present embodiment is thus characterized in that an increase in ink types can be accommodated in the internal structure of the printing head by simply disposing the second ink tanks in a quantity corresponding to the ink types and in that peripheral mechanisms (such as the shell element, pump unit, and stopper) can be used commonly, which provides a very much advantageous technique in designing a portable thin, or compact printer.

Further, even when the second ink tanks have remaining inks in different amounts between the ink types, the expansion of each second ink tank occurring in response to depressurization can be prevented when the ink tank abuts on the stopper to allow the respective ink to be charged in a prescribed amount. This fundamentally eliminates the need for performing minute control in accordance with the difference between the amounts of the different types of remaining inks. When a design is employed in which the maximum ink capacity is different for each type of ink, inks can be automatically charged to the respective maximum capacities. This is very much advantageous for a design in which different capacities are provided for a black ink and a color ink, for instance.

The time required for charging each ink may be calculated from an amount used or consumed to set a charging time that can be varied according to the ink that requires the longest charging time.

(Third Embodiment)

As a third embodiment of the invention, a description will now be made on a structure for achieving a further reduction of the sequence for charging a second ink tank from those in the first and second embodiments.

In the first and second embodiment, an adequate negative pressure is generated by performing an ink returning operation through pressurization for a short time (Steps 6 and 13 in FIG. 6) after the operation of charging a second ink tank with ink by reducing the pressure in the shell element. On the contrary, the present embodiment basically relates to a structure for making it possible to obtain an adequate negative pressure only by completing the charging operation through depressurization without such the pressurization and reducing the time required for enabling printing.

Figure 13:
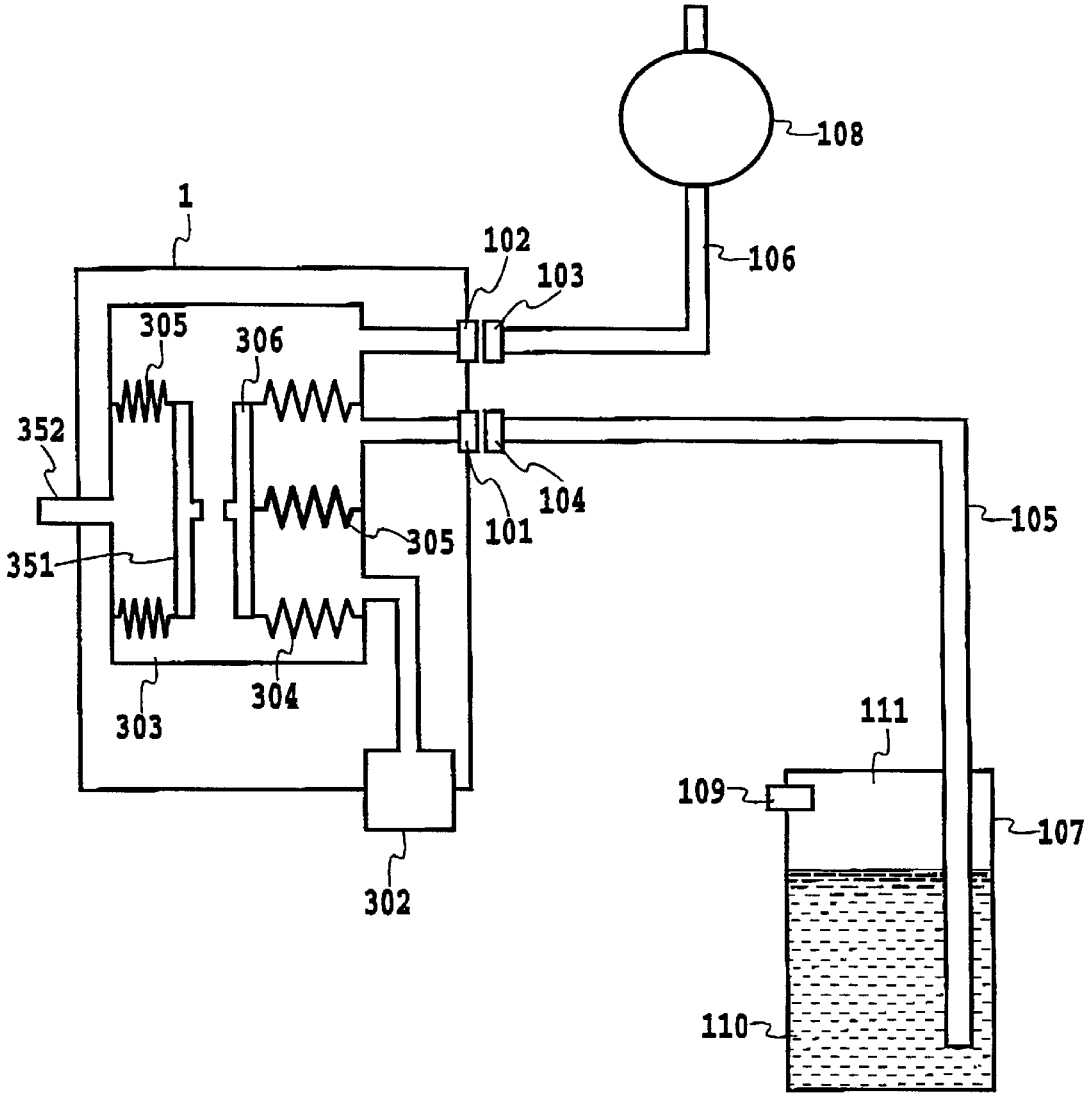
FIG. 13 is a schematic side view for explaining a third example of an internal structure of a printing head unit used for an intermittent supply system.

FIG. 13 is an illustration for explaining an internal structure of a printing head unit 1 used in an intermittent supply system of the present embodiment and connection circuits coupled with and located around the same Parts that can be configured in the same way as in FIG. 4 are indicated by like reference numbers in corresponding locations.

The structure of the present embodiment is different from the structure in FIG. 4 in that the fixed stopper 307 in FIG. 4 is replaced with a regulating member 350 which expands with a second ink tank 304 to abut on the second ink tank 304 to regulate the expansion of the same.

Like the second ink tank 304, the expansion regulating member 350 is basically constituted by a structural body, in the form of bellows for example, which has a flexible structure that can be displaced or deformed to have a variable internal volume. It has an atmosphere communication port 352 for communicating the interior thereof with the atmosphere and an abutting section 351 that abuts on an abutting member 306 of the second ink tank as a result of expansion.

With such a structure, a venting process and an ink charging process can be performed on the second ink tank 304 by using a control procedure similar to that shown in FIG. 6, and an operation during depressurization is as follows. Since the pressure in a shell element 303 is reduced below the atmospheric pressure by operating a pump unit 108 for depressurization, the second ink tank 304 expands, and ink flows into the second ink tank 304 from a first ink tank 107 through a tube member 105 and valve units 104 and 101. At the same time, the expansion regulating member 350 also expands because outside air flows into the expansion regulating member 350 through the atmosphere communication port 352. When the depressurizing operation is continued, the abutting member 306 of the second ink tank 304 and the abutting section 351 of the expansion regulating member 350 finally abut on each other, and any further expansion of the second ink tank 304 is prevented by the abutment of them.

In the structure in FIG. 4, when an ink charging operation is completed with the abutting member 306 of the second ink tank 304 abutting on the stopper 307, the compression spring 305 cannot freely expand. In the procedure in FIG. 6, a pressurizing operation is performed for a short time to push a small amount of ink in the second ink tank 304 back to the first ink tank 107; the second ink tank 304 is thereby contracted to space the abutting member 306 from the stopper 307; and an adequate negative pressure is thus generated by the compression spring 305.

In the present embodiment, however, the depressurizing operation is stopped after the operation of charging the second ink tank 304 with ink as a result of the abutment of the second ink tank 304 and the expansion regulating member 350 by defining the structures of them appropriately, and the interior of the shell element 303 is exposed to the atmosphere. The expansion regulating member 350 in communication with the atmosphere can retract to allow the compression spring 305 to extend and, in the resultant state, an adequate negative pressure is generated in the second ink tank 304. The time required for enabling printing is thus reduced.

Figure 14:
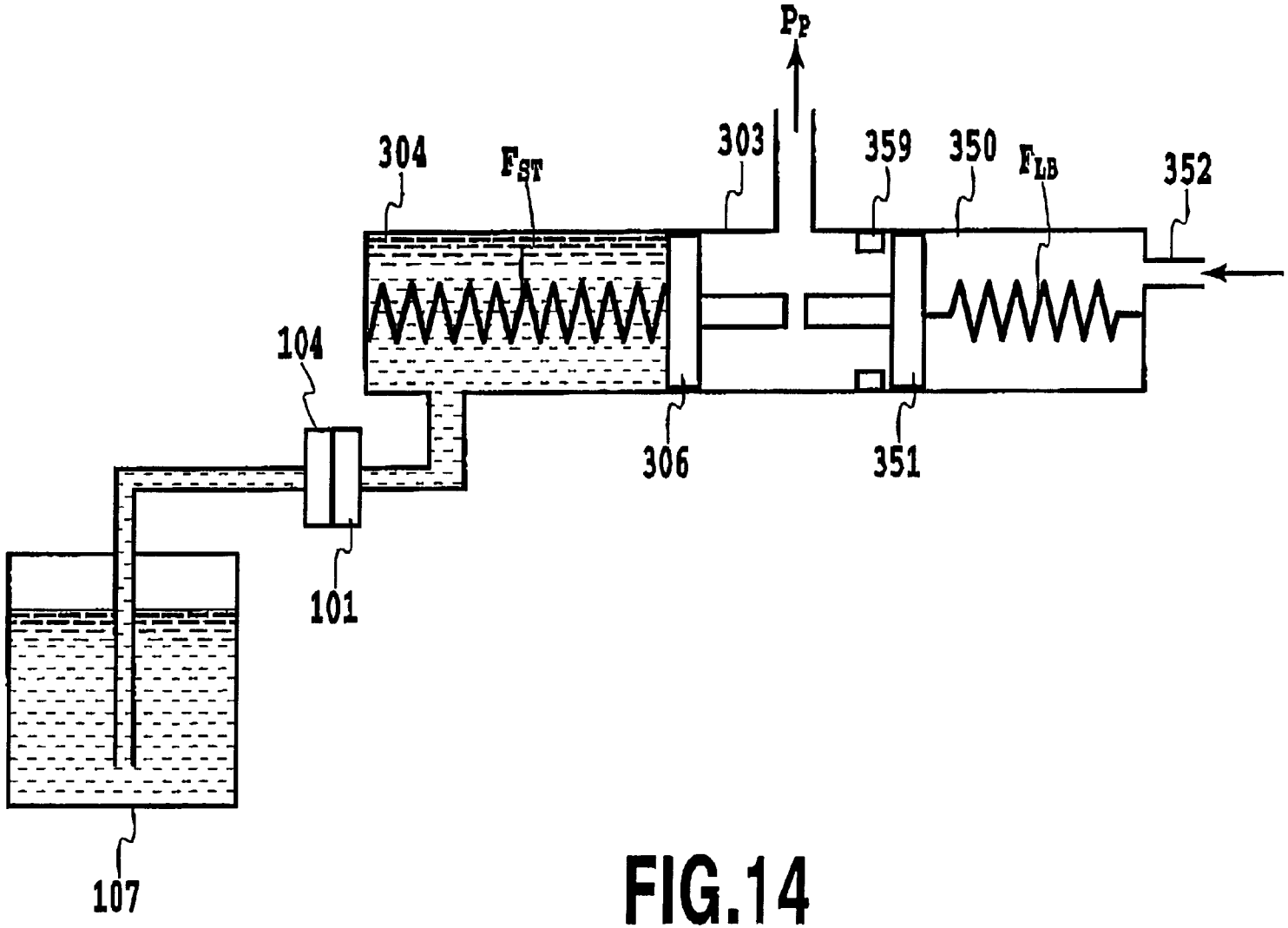
FIG. 14 is an illustration for explaining the principle of the operation of the structure in FIG. 13.

The principle of the operation of the present embodiment will be described with reference to FIG. 14. FIG. 14 shows a model of the structure in FIG. 13, a part of a shell element 303 shown as a cylinder on the left side thereof corresponding to the second ink tank 304, a part of the same on the right side thereof corresponding to the expansion regulating member 350. A space located between those parts is in communication with the pump unit 108, and a pressure Pp is applied to the same as a result of a depressurizing operation. Fst represents a composite spring force provided by the second ink tank 304 itself and the compression spring 305, and Flb represents a spring force of the expansion regulating member 350 itself. A pressure that is applied to the second ink tank 304 in accordance with the relationship between the heights of the first ink tank 107 and the second ink tank 304 (the difference between the head heights) is represented by Pit.

Pressure bearing areas of the abutting member 306 of the second ink tank 304 and the abutting section 351 of the expansion regulating member 350 are represented by Ast and Alb, respectively. When the second ink tank 304 is expanded by the depressurizing operation of the pump unit 108, the abutting member 306 of the second ink tank 304 is moved rightward in the figure by a force applied thereto that is expressed by:

$$(Pp \times Ast)+Fst+(Pit \times Ast)$$

The abutting section 351 of the expansion regulating member 350 is moved leftward in the figure by a force applied thereto that is expressed by:

$$(Pp \times Alb)-Flb$$

In order for the abutting sections to abut on each other and to stop in such a state, the following condition must be satisfied.

$$(Pp \times Ast)+Fst+(Pit \times Ast)=(Pp \times Alb)-Flb$$

The expansion of the second ink tank 304 is regulated in an adequate position to complete charging if conditions such as the dimensions and specifications of each part are determined such that the above condition is satisfied.

In order to regulate the expansion of the second ink tank with reliability, the right side of the above equation (or the force applied to the abutting section 351 of the expansion regulating member 350) is preferably greater than the left side (or the force applied to the abutting member 306 of the second ink tank 306) It is also preferable to provide a stopper 359 for limiting the movement of the abutting section 351 of the expansion regulating member 350 at a predetermined position in order to prevent the second ink tank 304 from contracting in an undesirable amount after the abutment.

(Fourth Embodiment)

Figure 15:
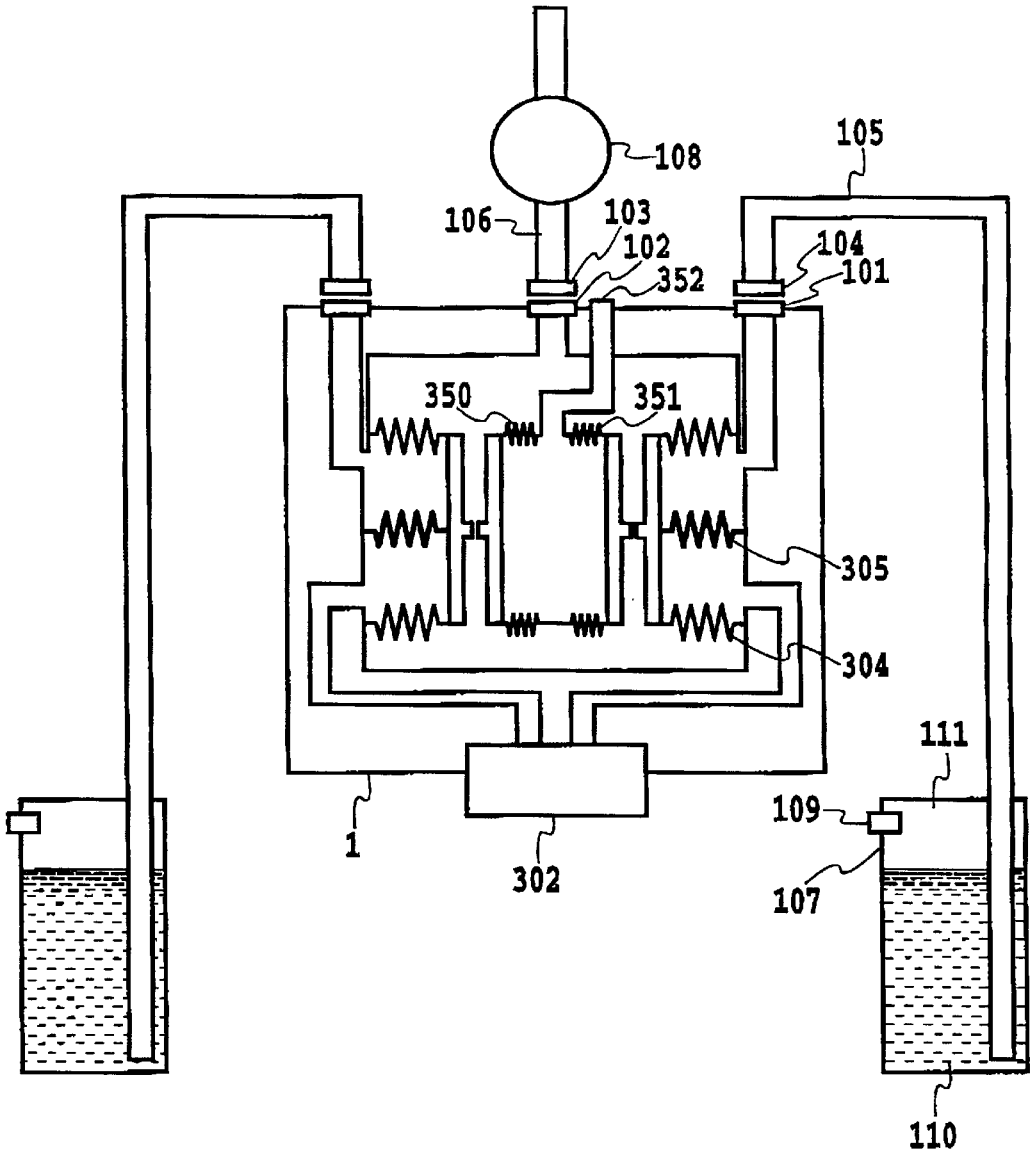
FIG. 15 is a schematic side view for explaining a fourth example of an internal structure of a printing head unit used for an intermittent supply system.

FIG. 15 shows a fourth embodiment of the invention. In the present embodiment, an intermittent supply system similar to the third embodiment is configured to accommodate inks of two or more colors or types.

While FIG. 15 shows an example of a structure to allow the use of two types of inks for simplicity, it is obvious that an intermittent supply system can be configured to allow the use of more types of inks, e.g., four or six types of inks based on the same idea. The present embodiment operates similarly to the second embodiment with similar advantages except that the expansion of second ink tanks 304 is regulated with a common expansion regulating member 350 and that the ink returning operation for generating a negative pressure may be omitted.

(Others)

Each of the embodiments shown in FIGS. 4, 11, 13, and 15 corresponds to the printing apparatus in FIG. 1 having a structure in which the valve units are coupled only when the second ink tank is charged with ink and in which the ink supply channel between the first and second ink tanks is spatially disconnected during a printing operation. However, the basic structures of those embodiments may be applied to the printing apparatus in FIG. 2 that employs an intermittent supply system configured to achieve fluid isolation between the first and second ink tanks.

That is, one end of a flexible tube member 150 for an air pressure circuit and one end of a flexible tube member 151 for supplying ink may be connected to the printing head 1 or the shell member 303 shown in each of FIGS. 4, 11, 13, and 15, and channel opening and closing units such as electromagnetic valve units 152 may be interposed between the tube members 150, 151 and the tube members 106, 105 instead of the valve units 101 through 104. An operation similar to that of the above embodiments can be performed by actuating the electromagnetic valve units 152 during a charging operation to connect the second ink tank 304 and the first ink tank 107 and to connect the interior of the shell element 303 and the pump unit 108.

The drawings associated with each of the above embodiments show the attitude of the intermittent supply system during normal use of the printing apparatus. In such an attitude, the first ink tank 107 satisfies the condition that the ink outlet port (the tip of the tube member) is located close to the bottom of the ink reservoir (in a lower part of the same in the direction of gravity), and the second ink tank 304 satisfies the condition that the section connected to the valve unit 101 and the section in communication with the printing head 302 are located in the highest and lowest positions respectively in the direction of gravity. However, demands for use in various attitudes may occur especially when compact and portable printing apparatus are to be configured, and it is desirable for this purpose to employ an intermittent supply system that satisfies the above conditions in a plurality of attitudes.

Figure 16A:
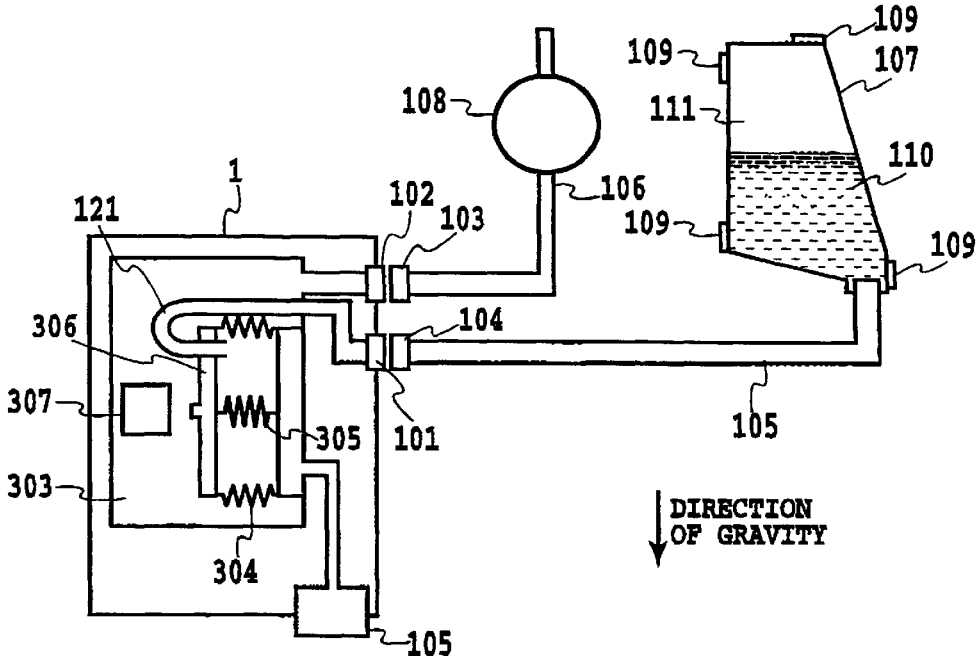
FIGS. 16A and 16B show an example of a structure of an intermittent supply system adapted to a printing apparatus that is used in various attitudes or orientation, FIG. 16A showing the attitude of the intermittent supply system when used in a certain orientation, FIG. 16B showing the attitude of the intermittent supply system when used in an orientation that is rotated by 90 degrees from the that attitude
Figure 16B:
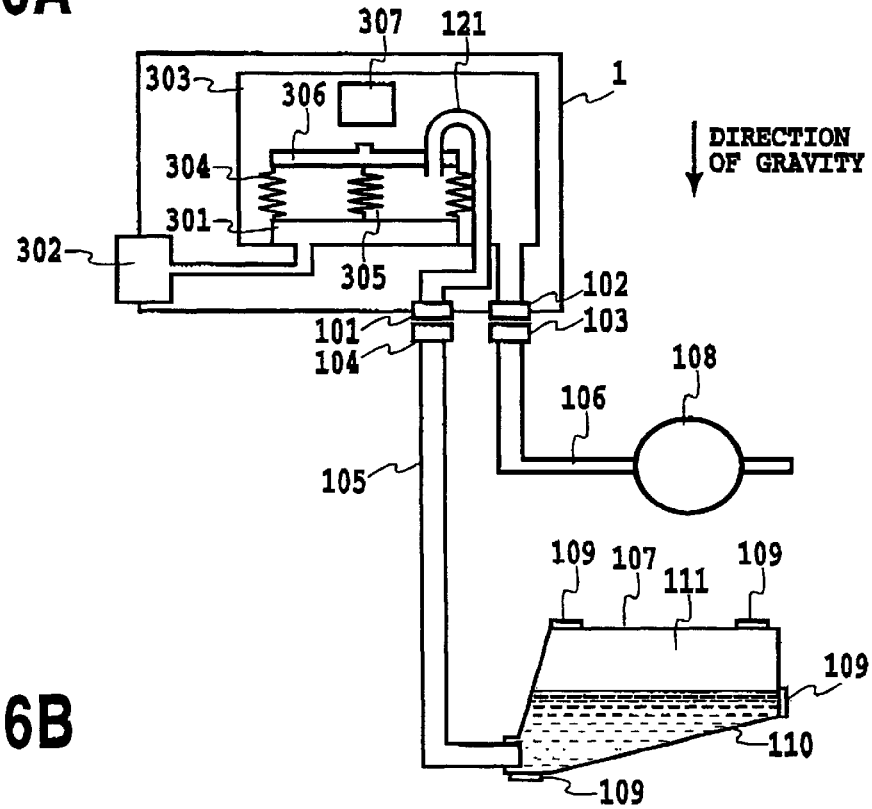

FIGS. 16A and 16B show an example of such a structure and show the attitude of an intermittent supply system when used in a certain orientation (FIG. 16A) and the attitude of the intermittent supply system when used in an orientation that is rotated by 90 degrees from the above attitude (FIG. 16B).

In the illustrated structure, the shape of the first ink tank 107 is defined such that it will have a portion located in the lowest position of the ink reservoir in any attitude, and the ink outlet port (the tip of the tube member 105) is connected to the same portion. Further, a plurality of the atmosphere communication sections 109 each having a functional film is provided such that some of them will be located in a position higher than the ink level in any attitude.

Referring to the second ink tank 304, the section in communication with the printing head 302 is located in the lowest position in the direction of gravity in either of the attitudes in FIGS. 16A and 16B; an ink introducing section is provided in a position that is in a substantially diagonal relationship with the position of the communication section; and the introducing section and the valve unit 101 are connected with a flexible tube 120.

Such a structure makes it possible to provide an appropriate intermittent supply system that is less limited with respect to its attitude in use in that the requirements for the first ink tank 107 and the second ink tank 304 are satisfied in either of the attitudes in FIGS. 16A and 16B or in an attitude that is intermediate between them.

While the structure shown in FIGS. 16A and 16B is a structure of an intermittent supply system adapted to a printing apparatus that can be used in orientations within a range of rotation of approximately 90 degrees, other structures are obviously possible which accommodate attitudes in different ranges of angles. While FIGS. 16A and 16B show a structure in which one type of ink is used, a structure adapted to plural types of inks as shown in FIG. 11 may be employed.

As described above, the invention makes it possible to provide a structure in which an intermittent supply system is adopted as an ink supply system; a second ink tank is charged with ink with high efficiency in a short charging time; and ink is used with high efficiency as a whole. The invention thus contributes to the structure of a compact and portable inkjet printing apparatus.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An inkjet printing apparatus for performing printing on a printing medium by using a printing head for ejecting ink, comprising:

a first ink tank serving as a source of the ink;

a second ink tank which can be charged with the ink from said first ink tank and which supplies the ink to said printing head during printing; and ink transport means for charging said second ink tank with the ink from said first ink tank, wherein in relation to the direction of gravity in an orientation upon using said printing apparatus, a port of a channel located at a side of said second ink tank for supplying the ink from said first ink tank to said second ink tank is arranged relatively high position and an ink outlet port for supplying the ink from said second ink tank to said printing head is arranged relatively low position respectively, and a port of said channel located at a side of said first ink tank is arranged to position at the bottom of said first ink tank.

2. A printing apparatus as claimed in claim 1, wherein in relation to the direction of gravity in an orientation upon using said printing apparatus, said port of said channel located at the side of said first ink tank is positioned lower than an atmosphere communication section for communicating the interior of said first ink tank with the atmosphere.

3. A printing apparatus as claimed in claim 2, wherein the atmosphere communication section is provided with a film that allows only a gas to pass and disallows a liquid to pass.

4. A printing apparatus as claimed in claim 1, wherein a plurality of the atmosphere communication sections for communicating the interior of said first ink tank with the atmosphere are provided such that at least one of them is always in a position higher than the level of the ink contained in said first ink tank.

5. A printing apparatus as claimed in claim 1, wherein said first ink tank has an ink reservoir that can be deformed to have a variable internal volume and an atmosphere communication section to allow said reservoir to be deformed in equilibrium with the atmosphere.

6. A printing apparatus as claimed in claim 1, wherein each of said first ink tank and said second ink tank has a structure in which ink and a gas can be separated downward and upward respectively in the direction of gravity without any obstacle.

7. A printing apparatus as claimed in claim 6, wherein the ink is contained as the ink is in spaces in each of said first ink tank and said second ink tank.

8. A printing apparatus as claimed in claim 1, wherein the ink transport means can return the contents of said second ink tank to said first ink tank, and in relation to the direction of gravity in an orientation upon using said printing apparatus, a starting point of a channel for the returning is in a relatively high position on said second ink tank in relation to the direction of gravity and a starting point of the channel for supplying ink to said printing head is in a relatively low position on said second ink tank in relation to the direction of gravity.

9. A printing apparatus as claimed in claim 8, wherein said channel for supplying the ink from said first ink tank to said second ink tank is also used as said channel for returning the contents to said first ink tank.

10. A printing apparatus as claimed in claim 8, wherein said second ink tank has a structure in which the internal volume thereof can be changed, and said ink transport means has internal volume changing means for applying a force to said second ink tank such that the internal volume is increased to charge said second ink tank with the ink from said first ink tank and such that the internal volume is reduced to return the contents of said second ink tank to said first ink tank.

11. A printing apparatus as claimed in claim 10, wherein said second ink tank has a structure which expands and contracts to increase and reduce the internal volume and wherein, said internal volume changing means has a shell element for containing said second ink tank, and said ink transport means has pressurizing and depressurizing means for depressurizing and pressuring the interior of said shell element to expand and contract said second ink tank.

12. A printing apparatus as claimed in claim 8, wherein said printing apparatus can be used in at least two attitudes in different orientation, said second ink tank has a structure in which the starting point of said channel for the returning at said second ink tank is in a relatively high position on said second ink tank in the direction of gravity and the starting point of said channel for supplying the ink to said printing head is in a relatively low position on said second ink tank in the direction of gravity in either of the two attitudes.

13. A printing apparatus as claimed in claim 1, further comprising channel opening and closing means for forming and blocking said channel connecting said first ink tank and said second ink tank.

14. A printing apparatus as claimed in claim 1, wherein said printing apparatus can be used in at least two attitudes in different orientation and said first ink tank has a structure in which said port of said channel in said first ink tank is located at the bottom of said first ink tank in relation to the direction of gravity in either of the two attitudes.

15. A printing apparatus as claimed in claim 1, wherein said printing apparatus can be used in at least two attitudes in different orientation, said second ink tank has a structure in which said port of said channel located at the side of said second ink tank for supplying ink from said first ink tank to said second ink tank is located at relatively high position and said ink outlet port for supplying ink from said second ink tank to said printing head is located at relatively low position in relation to the direction of gravity in either of the two attitudes, and said first ink tank has a structure in which said port of said channel in said first ink tank is located at the bottom of said first ink tank in relation to the direction of gravity in either of the two attitudes.

16. A printing apparatus as claimed in claim 1, wherein said printing head has a heating element for generating thermal energy that causes film boiling of ink as energy used to eject the ink.

17. An ink supplying method used for an inkjet printing apparatus for performing printing on a printing medium by using a printing head for ejecting ink, said method comprising the steps of:

providing an inkjet printing apparatus having:

a first ink tank serving as a source of the ink;

a second ink tank which can be charged with the ink from said first ink tank and which supplies the ink to said printing head during printing; and ink transport means for charging said second ink tank with the ink from said first ink tank, wherein in relation to the direction of gravity in an orientation upon using said printing apparatus, a port of a channel located at a side of said second ink tank for supplying ink from said first ink tank to said second ink tank is arranged relatively high position and an ink outlet port for supplying the ink from said second ink tank to said printing head is arranged relatively low position respectively, and a port of said channel located at a side of said first ink tank is arranged to position at the bottom of said first ink tank; and wherein the ink transport means can return the contents of said second ink tank to said first ink tank, and in relation to the direction of gravity in an orientation upon using said printing apparatus, a starting point of a channel for the returning is in a relatively high position on said second ink tank in relation to the direction of gravity and a starting point of the channel for supplying the ink to said printing head is in a relatively low position on said second ink tank in relation to the direction of gravity;

charging said second ink tank with the ink from said first ink tank by increasing the internal volume of said second ink tank; and returning the contents of said second ink tank to said first ink tank by reducing the internal volume of said second ink tank.

18. An ink supplying method as claimed in claim 17, further comprising control step of causing the process of returning the contents of said second ink tank to said first ink tank prior to said charging step according to a predetermined judgment.

* * * * *

UNITED STATES PATENT AND TRADEMARK OFFICE

CERTIFICATE OF CORRECTION

PATENT NO. : 6,663,233 B2
DATED : December 16, 2003
INVENTOR(S) : Naoji Otsuka et al.

It is certified that error appears in the above-identified patent and that said Letters Patent is hereby corrected as shown below:

Column 1,
Line 15, “Descritpion” should read -- Description --.

Column 3,
Line 53, “ink” should read -- e.g., ink --.

Column 7,
Line 4, “the” should be deleted.

Column 8,
Line 41, “away” should read -- away from --.

Column 11,
Line 31, “is” should be deleted.

Column 15,
Line 25, “maybe” should be -- may be --; and
Line 33, “of” should read -- of the --.

Column 17,
Line 9, “followings.” should read -- following --.

Column 18,
Line 39, “one of” should read -- one of the --; and
Line 63, “separated” should read -- separated from --.

Column 25,
Line 16, “pressuring” should read -- pressurizing --.

Signed and Sealed this

Tenth Day of August, 2004

JON W. DUDAS
*Acting Director of the United States Patent and Trademark Office*